US007449626B2

(12) United States Patent
Chen

(10) Patent No.: US 7,449,626 B2
(45) Date of Patent: Nov. 11, 2008

(54) MODULAR SINGLE-TOWER DRUM PEDAL SYSTEM

(75) Inventor: Erh Chiang Chen, Chino, CA (US)

(73) Assignee: Taye Inc., Chino, CA (US)

( * ) Notice: Subject to any disclaimer, the term of this patent is extended or adjusted under 35 U.S.C. 154(b) by 0 days.

(21) Appl. No.: 11/624,430

(22) Filed: Jan. 18, 2007

(65) Prior Publication Data

US 2008/0173159 A1 Jul. 24, 2008

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS

| | | | | | |
|---|---|---|---|---|---|
| 800,509 | A | * | 9/1905 | Stanton | 84/422.1 |
| 2,446,508 | A | * | 8/1948 | Crowell | 84/422.1 |
| 2,469,582 | A | * | 5/1949 | Emerson | 84/293 |
| 2,586,163 | A | * | 2/1952 | Heiderich et al. | 84/422.4 |
| 2,784,635 | A | * | 3/1957 | Troppe | 84/422.1 |
| 2,893,284 | A | * | 7/1959 | Washington, Jr. | 84/422.1 |
| 3,030,847 | A | * | 4/1962 | Thompson | 84/422.1 |
| 3,618,441 | A | * | 11/1971 | Fearns | 84/422.1 |
| 3,750,517 | A | * | 8/1973 | Sleishman | 84/422.1 |
| 3,797,356 | A | * | 3/1974 | Duffy et al. | 84/422.1 |
| 3,834,266 | A | * | 9/1974 | Robinson | 84/267 |
| 4,134,325 | A | * | 1/1979 | Loftus | 84/422.1 |
| 4,186,644 | A | * | 2/1980 | Kurosaki | 84/422.1 |
| 4,188,853 | A | * | 2/1980 | Bills | 84/422.1 |
| 4,198,894 | A | * | 4/1980 | Della-Porta et al. | 84/422.1 |
| 4,235,146 | A | * | 11/1980 | Purdy | 843/422.1 |
| 4,782,733 | A | * | 11/1988 | Herring | 84/422.1 |
| 4,819,536 | A | * | 4/1989 | Lombardi | 84/746 |
| 5,301,592 | A | * | 4/1994 | Johnston | 84/422.1 |
| 5,396,826 | A | * | 3/1995 | Lombardi | 84/422.1 |
| 5,431,081 | A | * | 7/1995 | Lombardi et al. | 84/422.1 |
| 5,646,360 | A | * | 7/1997 | Liao | 84/422.1 |
| D390,253 | S | * | 2/1998 | Bacco | D17/22 |
| 6,011,208 | A | * | 1/2000 | Hoshino | 84/422.1 |
| 6,028,259 | A | * | 2/2000 | Lombardi et al. | 84/422.1 |
| 6,037,532 | A | * | 3/2000 | Beckmeir | 84/293 |

(Continued)

*Primary Examiner*—Walter Benson
*Assistant Examiner*—Robert W Horn
(74) *Attorney, Agent, or Firm*—Rosenberg, Klein & Lee

(57) ABSTRACT

The invention relates to the modularity of a reversible symmetrical single-pillar vertical support assembly (the Tower) which is the major structural component for a drum beating pedal apparatus (drum pedal). Said drum pedal can also be used to beat, without limitation, other musical instruments and musical accessories. Upon this Tower can be constructed various single-beater, multiple-beater and remote drum pedals and drum beating mechanisms according to the operator's requirements. This modular single-Tower drum pedal system also comprises several ancillary inventions which also can be applied in concert with or independently of the said Modular Single-Tower Drum Pedal System. These ancillary inventions relate specifically to drum pedal elements that directly affect and control the adjustability of footboard length; chain and/or strap length; single and multiple drum beaters in all axial positions including side-to-side, up-and-down, and fore-and-aft directions; beater stroke arc length and beater velocity; independent multiple beater adjustability; reduced friction spring-rocker floating-bearing support assembly; adjustability of the eccentricity of the cam hub; and a hexagon-shape drum beater shaft for secure 3-way position of drum beater head.

41 Claims, 32 Drawing Sheets

U.S. PATENT DOCUMENTS 6,150,596 A * 11/2000 Hsieh ..... 84/422.1
6,156,961 A * 12/2000 Beckmeier ..... 84/293
6,180,860 B1 * 1/2001 Chen ..... 84/422.4
6,222,108 B1 * 4/2001 Liao ..... 84/422.1
6,570,076 B1 * 5/2003 Kjellgren ..... 84/422.1
6,689,945 B1 * 2/2004 Matsuzoe et al. ..... 84/422.1
6,762,354 B2 * 7/2004 Cocca ..... 84/422.1
6,894,210 B1 * 5/2005 Lombardi ..... 84/422.1
6,903,257 B2 * 6/2005 Yun ..... 84/422.1
6,924,422 B2 * 8/2005 Wise ..... 84/422.1
7,368,650 B2 * 5/2008 Hsieh ..... 84/422.1
2003/0000367 A1 * 1/2003 Sleishman ..... 84/422.1
2007/0107582 A1 * 5/2007 Hauck ..... 84/422.1
2007/0113722 A1 * 5/2007 Chen ..... 84/422.1
2008/0173159 A1 * 7/2008 Chen ..... 84/422.1

* cited by examiner

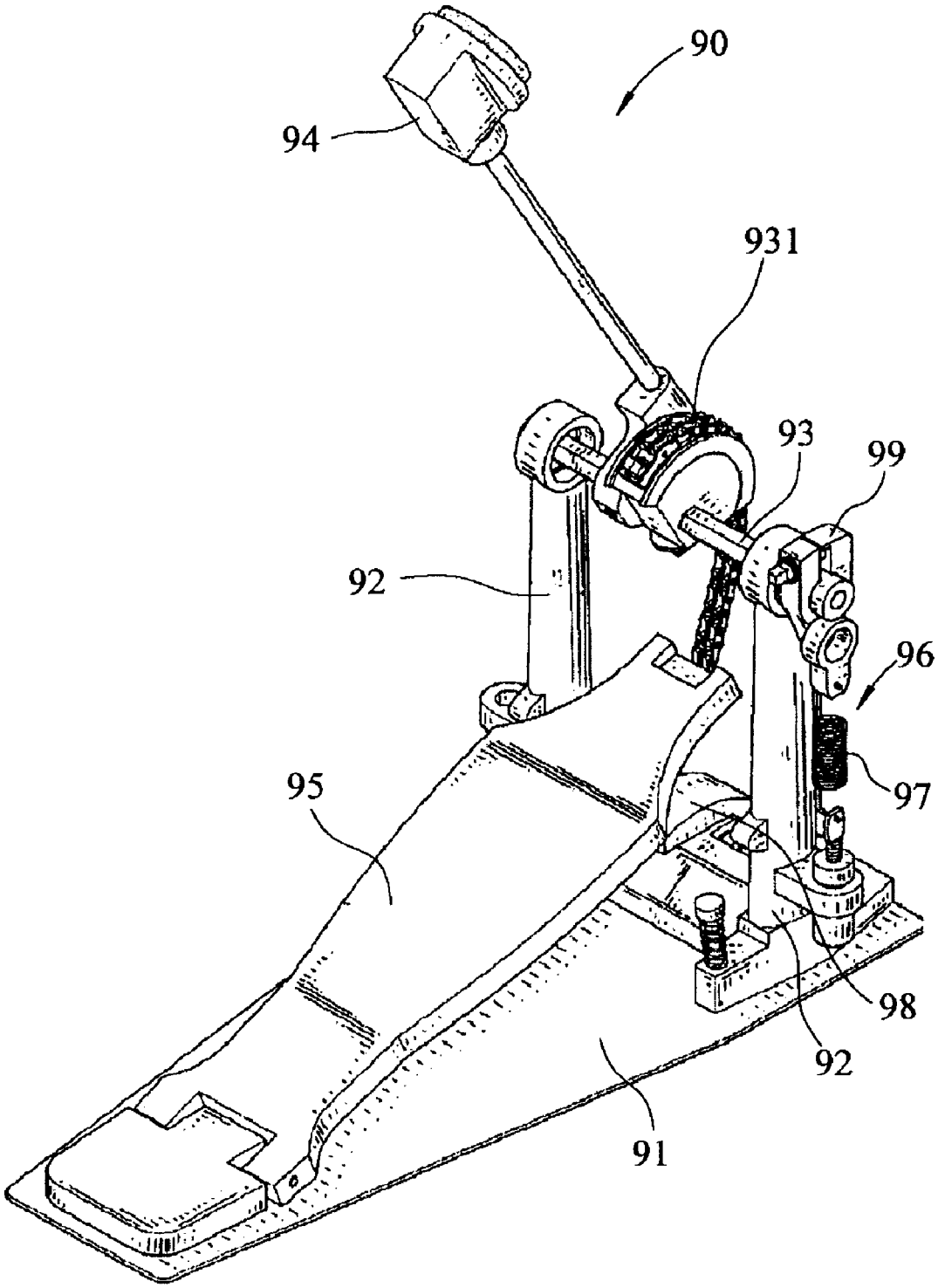
Fig. AA

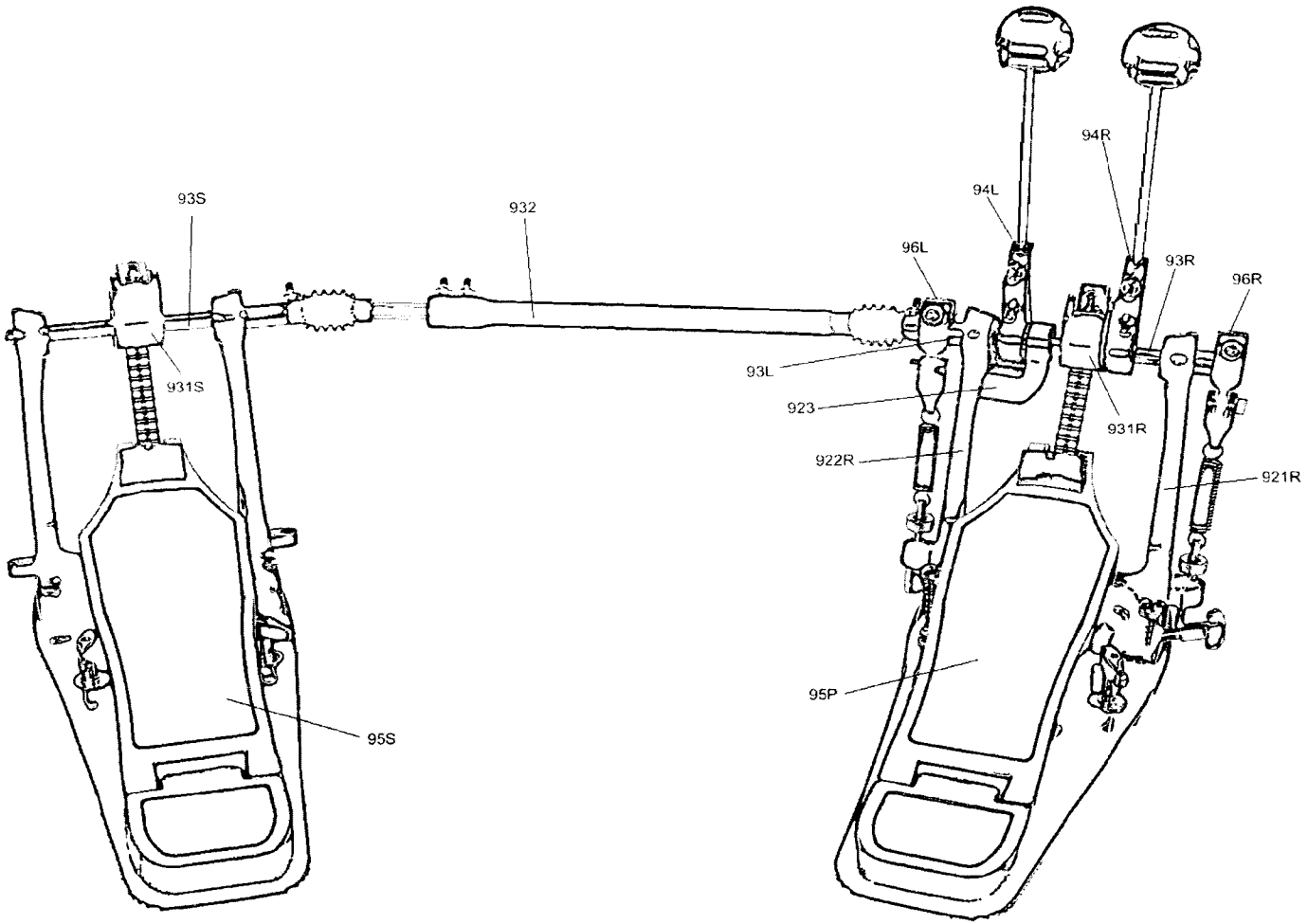
Fig. BB

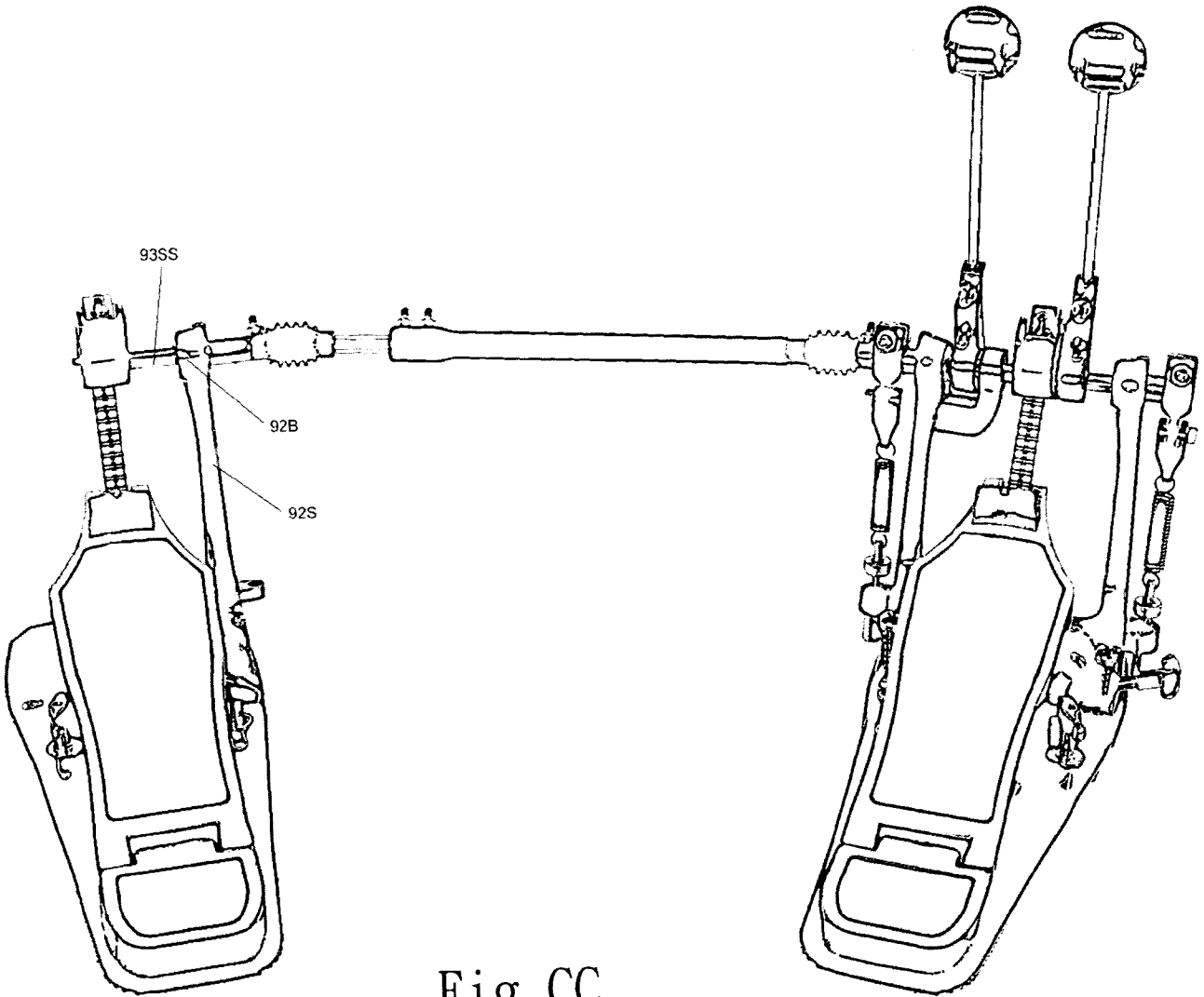
Fig. CC

SECTION D-D

MODULAR SINGLE-TOWER DRUM PEDAL SYSTEM

FIELD OF THE INVENTION

The present invention relates generally to musical drums and the beating of musical drums the operator using a mechanical apparatus. The invention relates specifically to the design and construction of single-beater and multiple-beater drum pedals and more specifically to a single-pillar vertical support assembly (called the Tower or the single-Tower) and the attachable mechanisms and accessories that comprise the named Modular Single Tower Drum Pedal System.

BACKGROUND OF THE INVENTION

The function of a mechanical drum beating pedal apparatus is to effect the beating of a drum or other musical instruments or musical accessories by impelling the drum beater or beaters of the apparatus with the operator's foot or feet or other convenient or appropriate conveyance. A conventional drum pedal is normally comprised of a vertical support structure attached to a base structure; said base structure is attached to a musical drum instrument. Said vertical support structure normally carries a primary horizontal driveshaft carried by one or two bearings which are normally attached to said vertical support structure, which is in turn attached to a foot pedal, the heel of which is pivotally attached to the base structure and the front of the pedal is articulately attached to the driveshaft so that the horizontal driveshaft is rotated when the pedal is depressed by the operator's foot. A spring balanced return mechanism repositions the horizontal driveshaft when foot pressure is released by the operator, returning the rotated driveshaft to its original position. The drum beater is attached to said horizontal driveshaft so that, as the horizontal driveshaft is rotated by the depressed pedal, it strikes the head of the drum, and as the operator's foot pressure is released, the beater returns to its original position. The vertical support structure of a conventional drum pedal is normally comprised of two vertical support pillars, which are moulded or otherwise attached to the base structure of said pedal, but sometimes the drum pedal is comprised of one vertical pillar moulded or attached to the said base structure. Usually, neither the conventional two-pillar vertical support structure nor the conventional single-pillar support structure can be converted into a multiple-beater drum pedal apparatus without the addition of costly parts that require additional design, tooling and special manufacture. The conventional two-pillar vertical support pedal structure, in order to be converted to accept a second beater for a conventional two-beater pedal, requires the costly addition of a third support pillar so that two separated drive shafts can be operated independently. Also, this third support pillar must be designed so that it can accommodate secondary foot pedal activation from either the right or the left, depending on the requirements of the operator which would include the requirement for the operator to drive the pedal secondary pedal with the left foot if the primary pedal is played with the right foot and conversely, the requirement to drive the secondary pedal with the right foot if the primary pedal is operated by the left foot. Single vertical pillar pedals normally support and carry the horizontal driveshaft with one bearing only, creating undue stress on said bearing. The field is devoid of vertical single-pillar single-beater drum beating pedal mechanisms that easily convert to double-beater pedals. The normal incidence of single vertical tower bass pedals is found used as part of a double beater apparatus and is normally used as the secondary drive pedal with no beater capability attached.

The primary purpose of this invention, named the Modular Single-Tower Drum Pedal System, is to provide a modular solution to creating a multiplicity of pedal beater configuration choices with the fewest numbers of relatively costly cast or machined parts. It is the modularity of the single-Tower design, which has a symmetrical shape to work either from the left or the right side of the pedal base structure, and that it is attachable and detachable on either the right side or the left side or both sides of the base structure, that is the essence of this invention. Also, two single-Tower pillars, sharing a single bearing support arm, can be mounted together on one pedal platform plate to create either a double-beater pedal or a reinforced double-Tower single-beater pedal with the addition of the requisite longer single driveshaft supported by bearings at either end of said longer driveshaft. The single-beater drum pedal can be modified easily to act as the drive for a double beater pedal for either the left foot or the right foot simply by choosing whether the single-Tower support structure is attached to the left side or the right side of the base structure. The single-Tower attaches and detaches easily to and from the base structure with ordinary bolt and nut fasteners that are simple and obvious for the operator to change with a normal wrench or other basic tool of appropriate design. Furthermore, the single-Tower combined with the Bearing Support arm securely support the horizontal driveshaft with two bearings supporting said driveshaft toward the ends of the said driveshaft. Said bearings are captured within the assembly of the single-Tower support structure as a consequence of the assembly of the tower and bearing support arm. The key elements are a Tower, which mated to a Bearing Support create the single-Tower. Two Towers can be mated to a single Bearing Support to create the double beater pedal, where two beaters are supported on a pedal base structure. Key to the success of the design is the ability to mate the Bearing Support Arm to one Tower to create the single beater pedal and to mate the single Bearing Support Arm to two Towers to create the double beater pedal. Furthermore, this invention, the Single-Tower Modular Drum Pedal System, is complemented by several new and unique designs and inventions for beater holder and adjustment, drive mechanism adjustment, spring functionality and foot pedal adjustment.

DESCRIPTION OF PRIOR ART

Three examples of conventional drum pedals are shown in FIG. AA, FIG. BB and FIG. CC.

FIG. AA shows a conventional twin pillar drum pedal assembly. FIG. BB shows a conventional double pillar double beater pedal and FIG. (CC) shows a conventional single pillar drum pedal used as a secondary pedal to drive the secondary beater of a conventional double pillar double beater pedal.

FIG. AA illustrates the conventional two-pillar single beater drum pedal which usually includes a base structure 91 with two vertical pillars 92 attached to and extending vertically from a top surface of the base structure 91 and a horizontal driveshaft 93 is connected between the two vertical pillars 92 and generally supported by bearings at each end of said driveshaft 93 and generally at the top end each vertical pillars 92. The drum beater 94 is securely connected to the driveshaft 93. One end of a foot pedal 95 is pivotally connected to the base structure 91. An articulated driving assembly 931 using chainlink or strap connects between the beater 94 and the other end of the foot pedal 95. To activate the beater 94 the operator depresses the foot pedal 95 which results in rotating the driveshaft 93 which in turn drives the beater head of beater 94 to strike the head of the drum. The drum is connected to the base structure 91 by means of a clamped attachment 98. The drumhead (membrane of drum) is aligned perpendicularly from the base structure 91 of the pedal. A spring-actuated returning device 96 is connected to one of the two vertical pillars 92 and includes an extension spring 97 which has one end connected to the a boss in the vertical pillars 92 and the other end of the spring 97 is connected with the spring return mechanism 99 which is attached to the driveshaft 93 so that the driveshaft 93 is rotated back to its initial position when the user releases pressure to the foot pedal 95.

FIG. BB is based on the pedal in FIG. AA. This double beater pedal shows a pedal 95P is part of the primary pedal and positioned to be operated by the right foot and pedal 95S is part of the secondary pedal and is positioned to be operated by the left foot. The pedal 95S when depressed activates the drive mechanism 931S rotating shaft 93S which is directly connected to driveshaft 93L by direct connection 932. A return spring assembly 96L is directly connected and returns the beater 94L to the original position when foot pressure is relieved on pedal 95S. Drum beater assemblies 94L and 94 R, Left and Right operate independently. Pedal 95S activates beater 94L and pedal 95P activates beater 94R. In order to facilitate this independent rotation of the two beaters these beaters need to rotate on separate driveshaft which in turn need to be supported independently. In order to do this a third vertical pillar 923 is attached to pillar 922R. Should the operator choose to place the secondary pedal on the left in order to operate the primary pedal with the right foot and the secondary pillar with the right foot, then a different costly change needs to be made to create the 923 to be attached to 921R Also, there is a weakness in the top of 923 where the separate drive shafts 93R and 931R meet inside 923.

FIG. CC shows essentially the same pedal features and functions as BB but the secondary pedal has a driveshaft 93SS supported by only one pillar 92S and one bearing 92B. Lack of support at both ends of the driveshaft 93SS offers no resistance to the twisting torque created by the playing of the mechanism. This single pillar design cannot be used to drive a double beater pedal as a secondary pedal played by the right foot. A different and costly single pillar attached to the left side of the base would be required.

SUMMARY OF THE INVENTION

The present invention relates to a drum pedal assembly which includes a horizontal base structure upon which at least one vertical pillar (the Tower) extends and a support has a connection section which is connected to a connection section extending laterally from at least the one vertical pillar to create a single-pillar support assembly (the single-Tower). A drive transmission unit has a horizontal driveshaft which is rotatably connected between at least the assembly of one vertical pillar and the support (the single-Tower assembly), and a pedal which is pivotally connected to rotate the driveshaft. A beater assembly is connected to the driveshaft and driven by the transmission unit. The vertical symmetrical Tower can be connected to either side of the base structure to meet the requirements of different operators and users. A drum beater adjusting unit, a pedal adjusting unit and a spring adjusting unit can be cooperated with the beater assembly to provide more adjustment functions.

The primary object of the present invention is to provide a drum pedal assembly that includes an adjustable single vertical tower attached to the base so that different users can use the beater assembly with more convenience and can easily configure the apparatus to be used in a variety of conventional and non-conventional single-beater and multiple-beater applications.

Another object of the present invention involves enhanced adjustability so as to provide a drum pedal assembly wherein the angle between the pedal and the base, the length of the base, the position of the beater along the driveshaft, the striking area of the beater on the drum head, the relative positions of double beaters on one drum head, the distance between the beater and the drum and the speed that the beater returns to its initial position can be all be adjusted.

The present invention will become more obvious from the following descriptions when taken in connection with the accompanying drawings which show, for purposes of illustration only, some of the preferred embodiments in accordance with the present inventions.

BRIEF DESCRIPTION OF THE DRAWINGS

FIG. AA shows a conventional single beater drum pedal with double pillars;

FIG. BB shows a conventional double beater drum pedal with double pillar secondary pedal and double pillar primary pedal;

Figure 1:
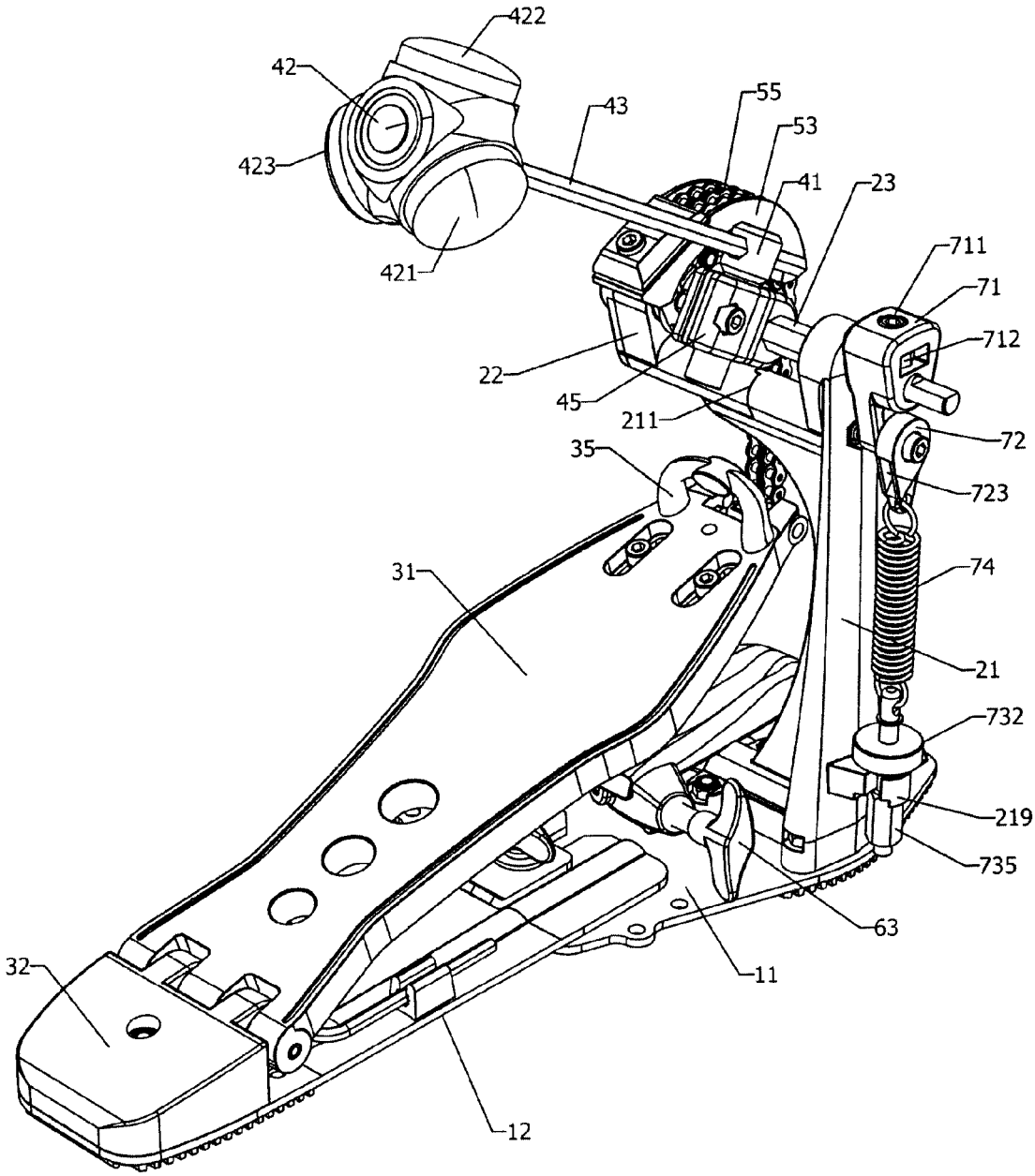
Figure 2:
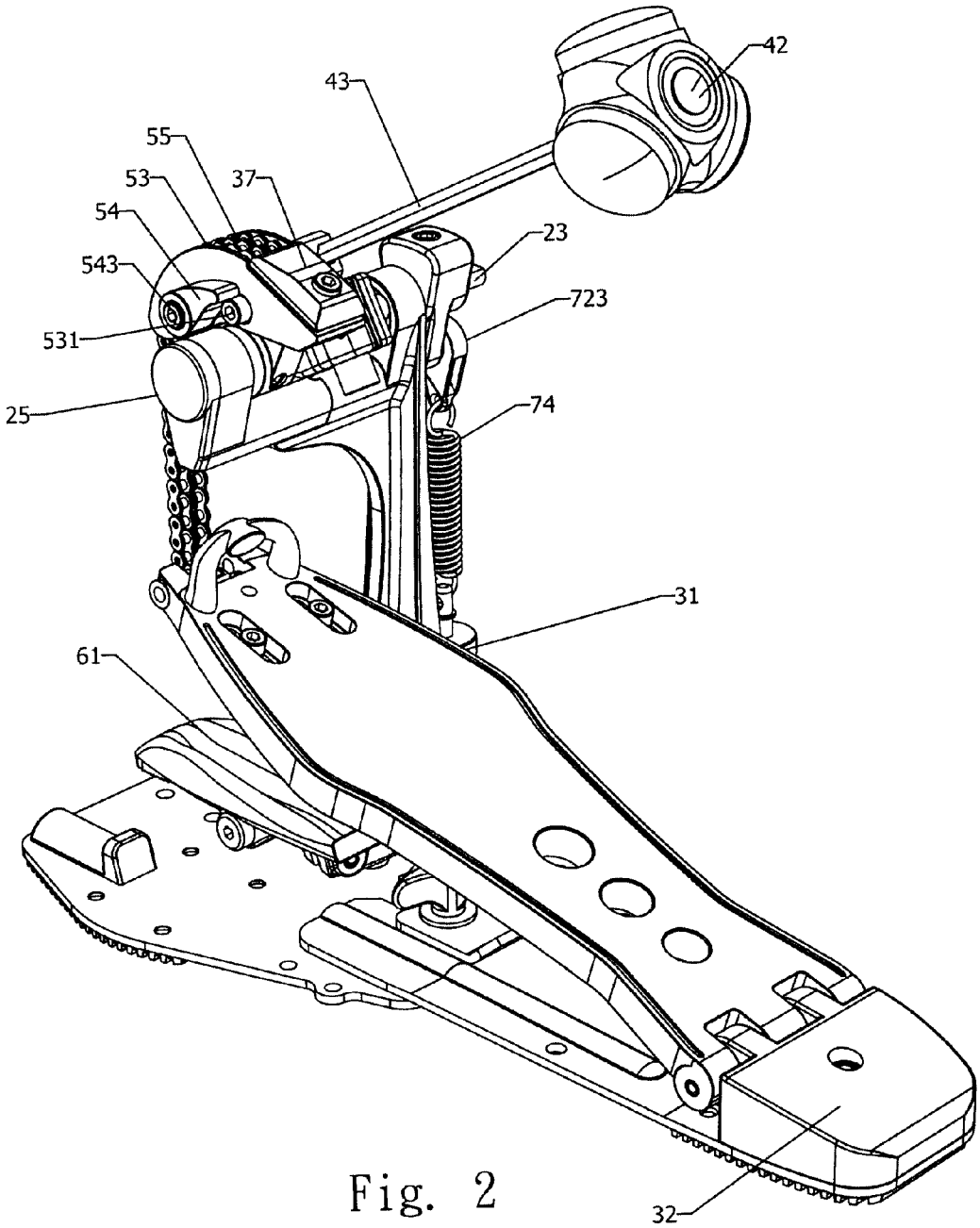
Figure 2A:
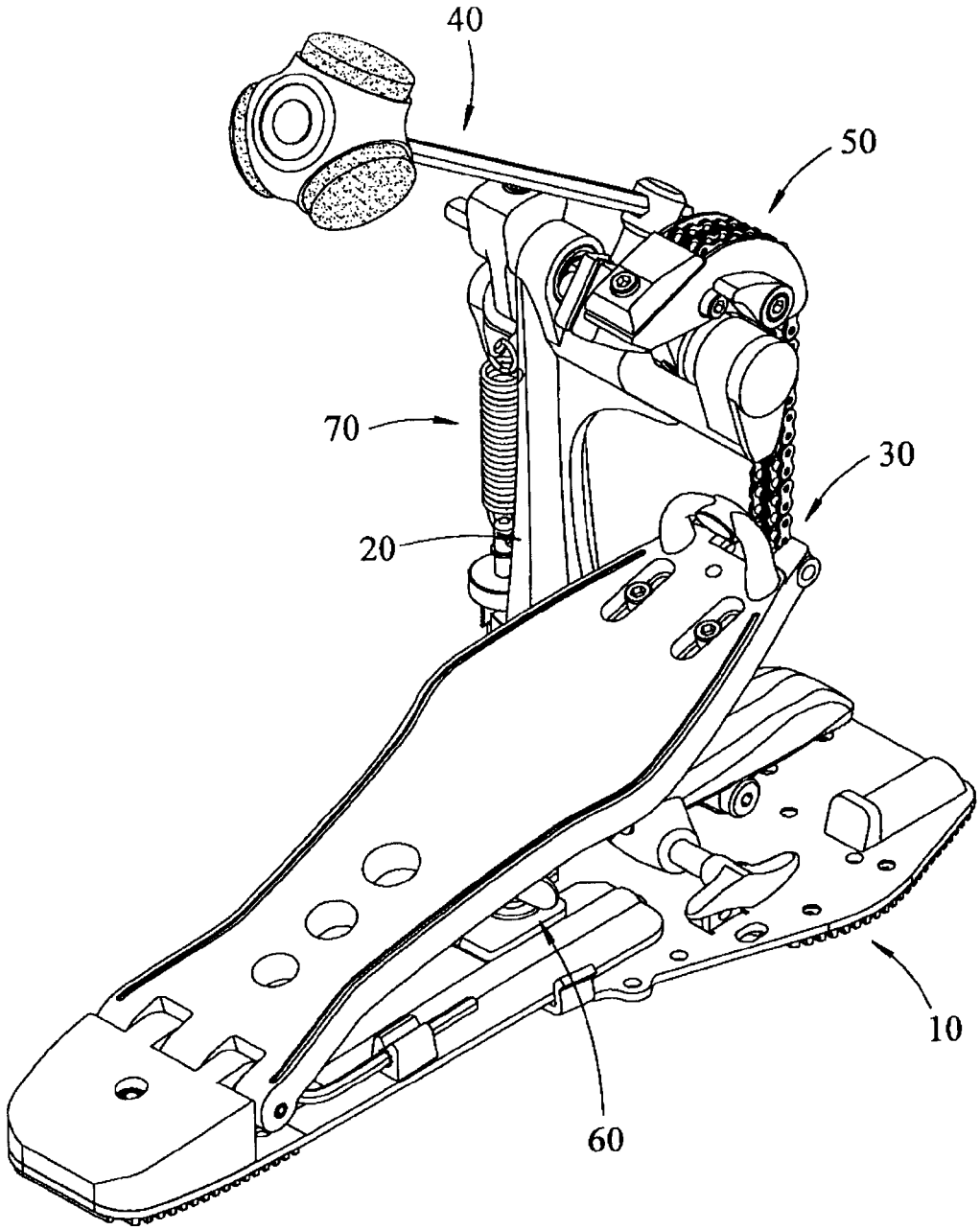
Figure 2B:
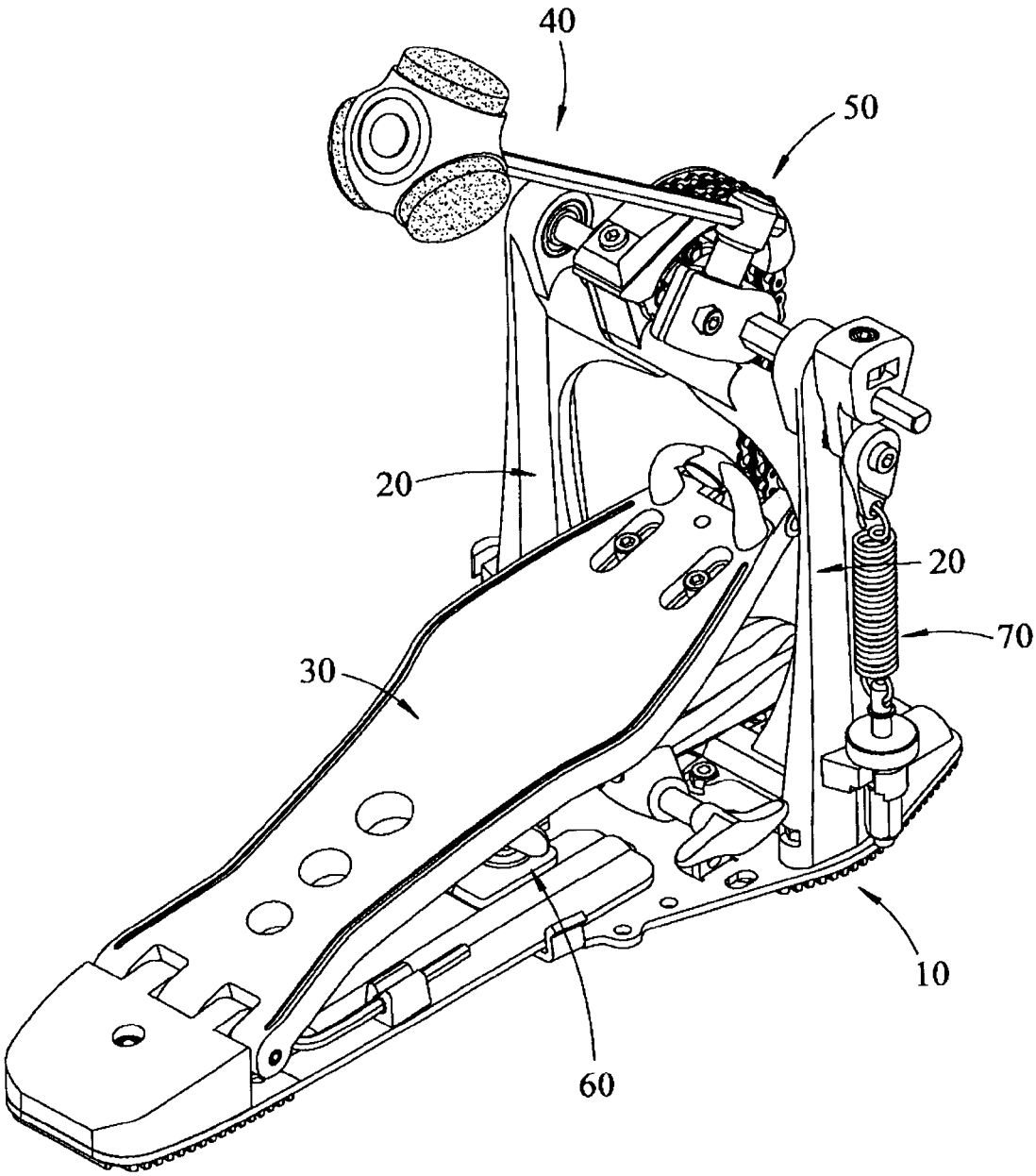
Figure 3:
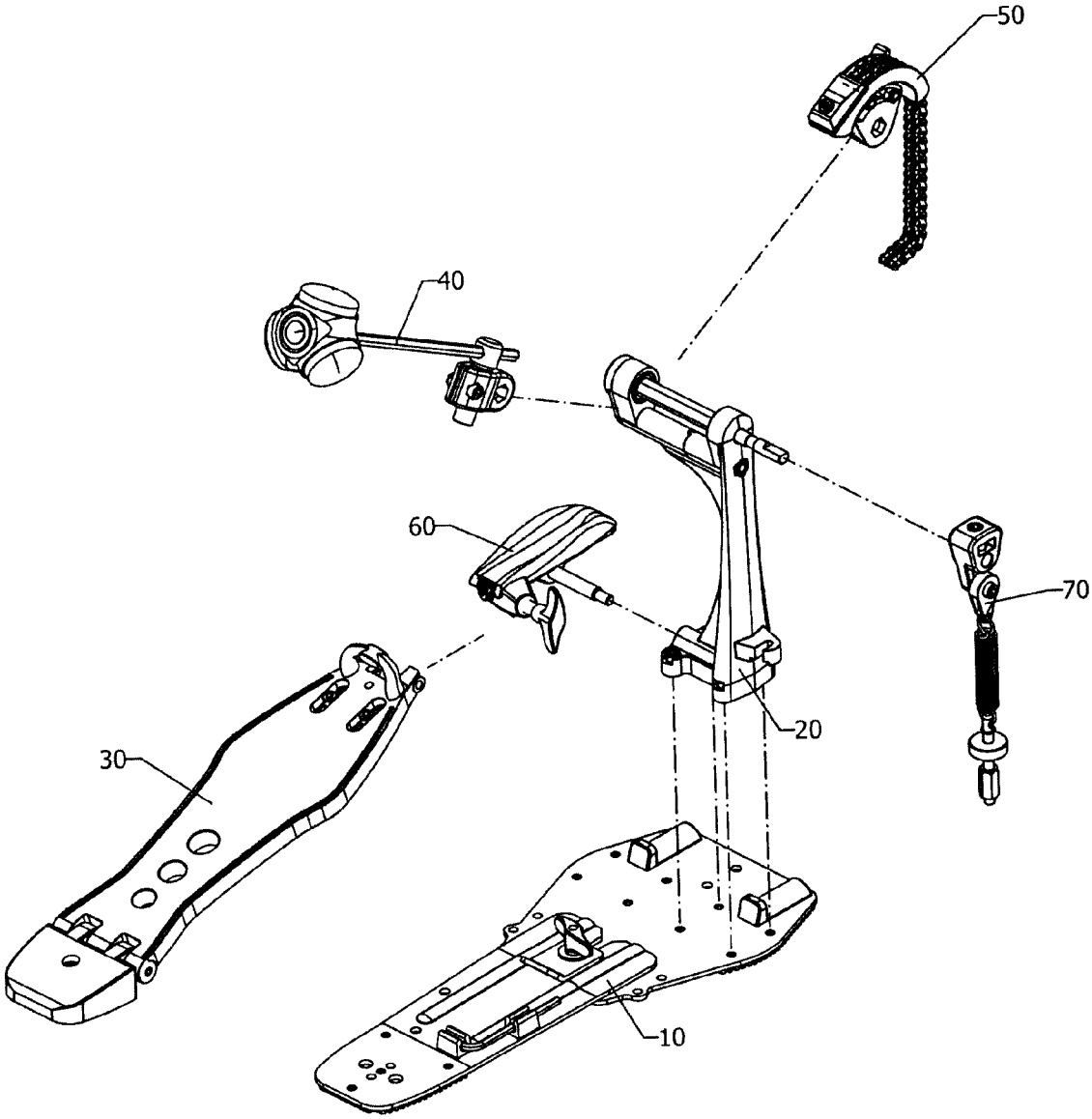
Figure 4:
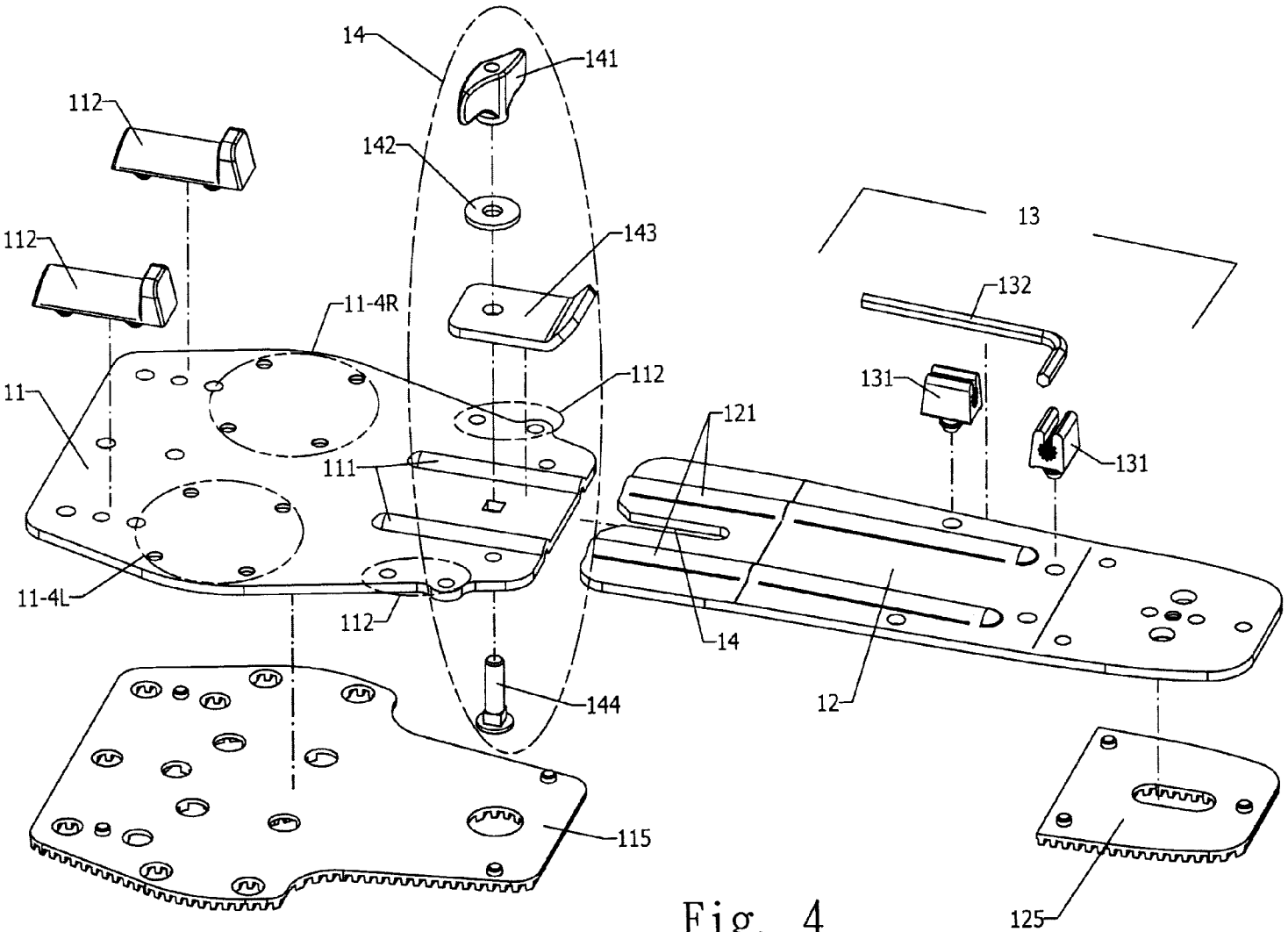
Figure 5A:
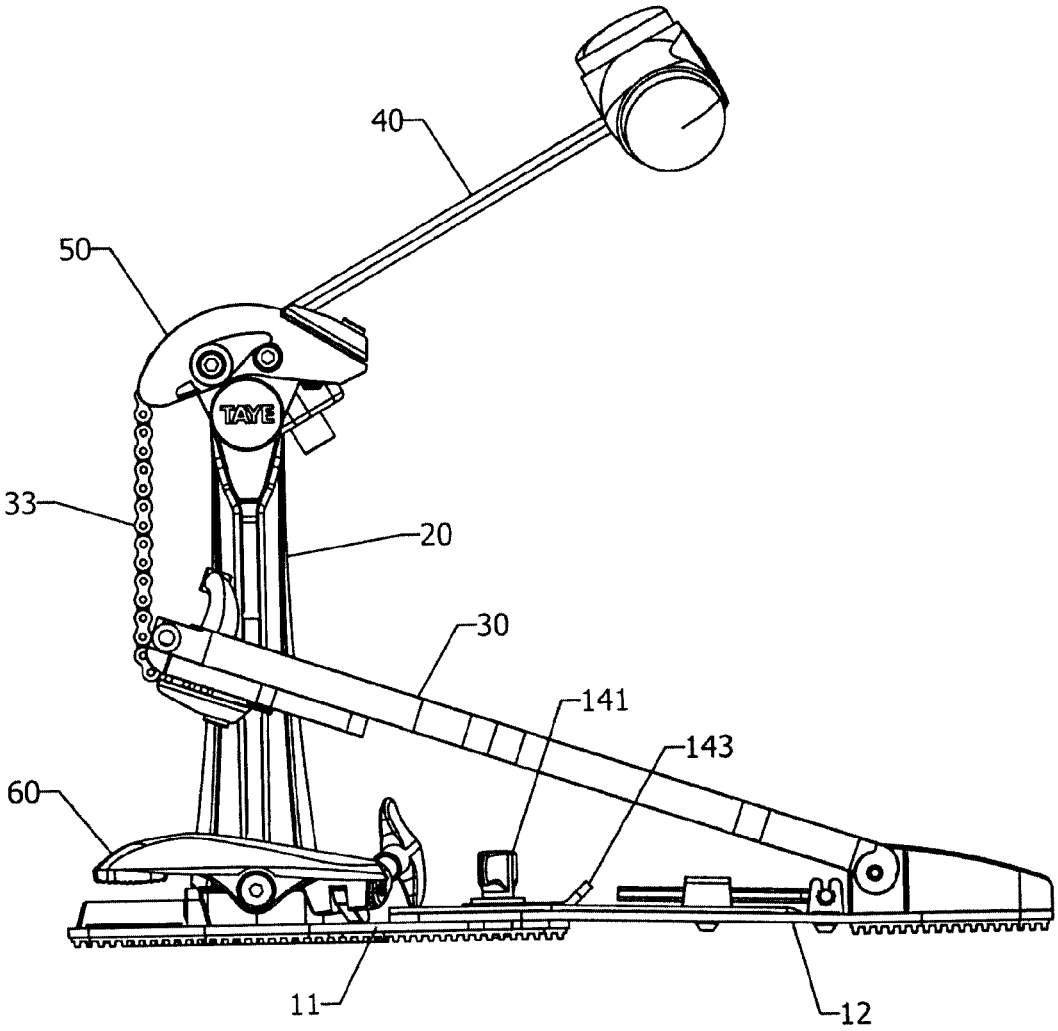
Figure 5B:
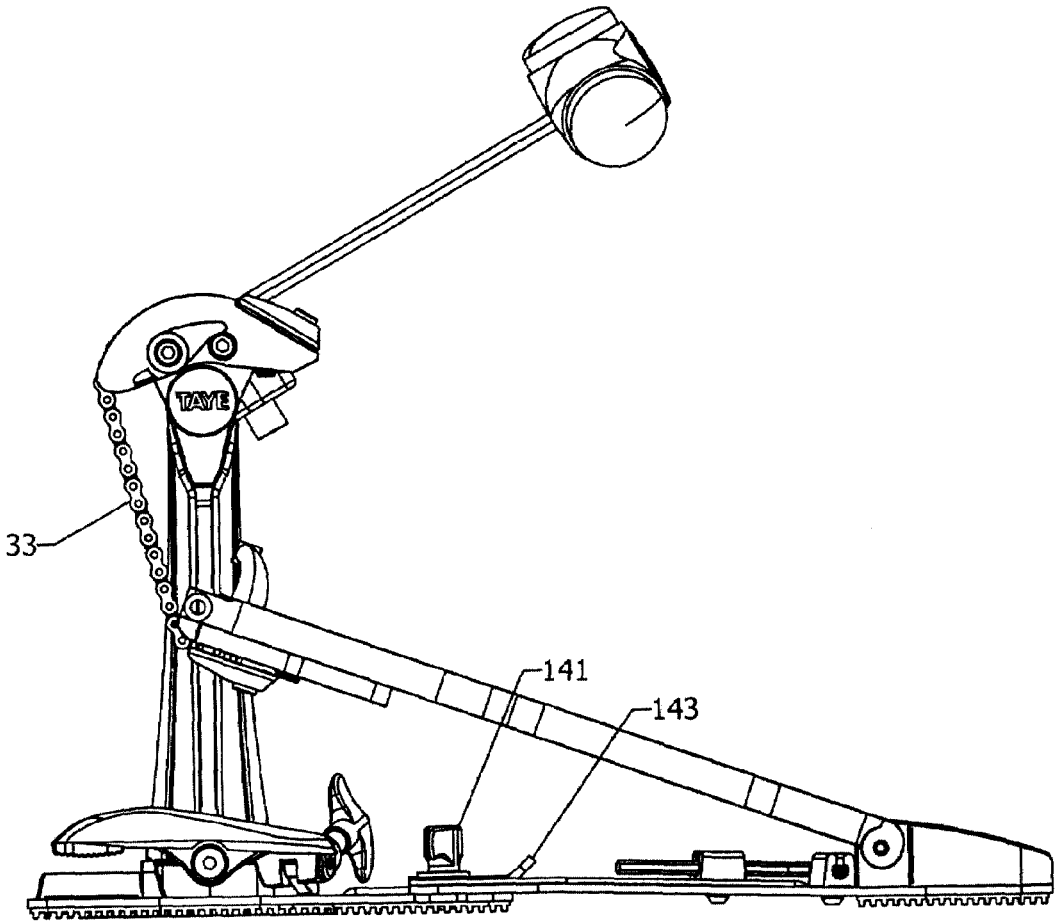
Figure 6:
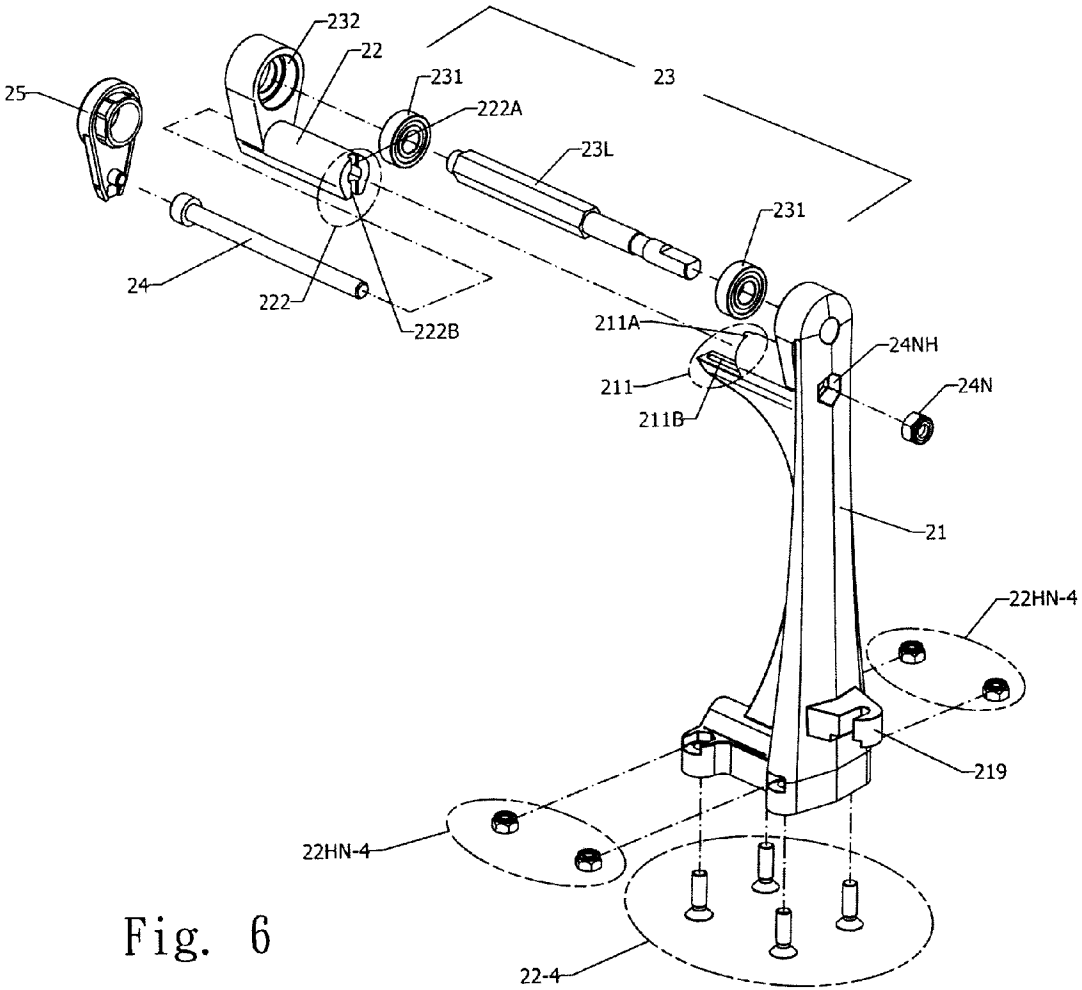
Figure 7:
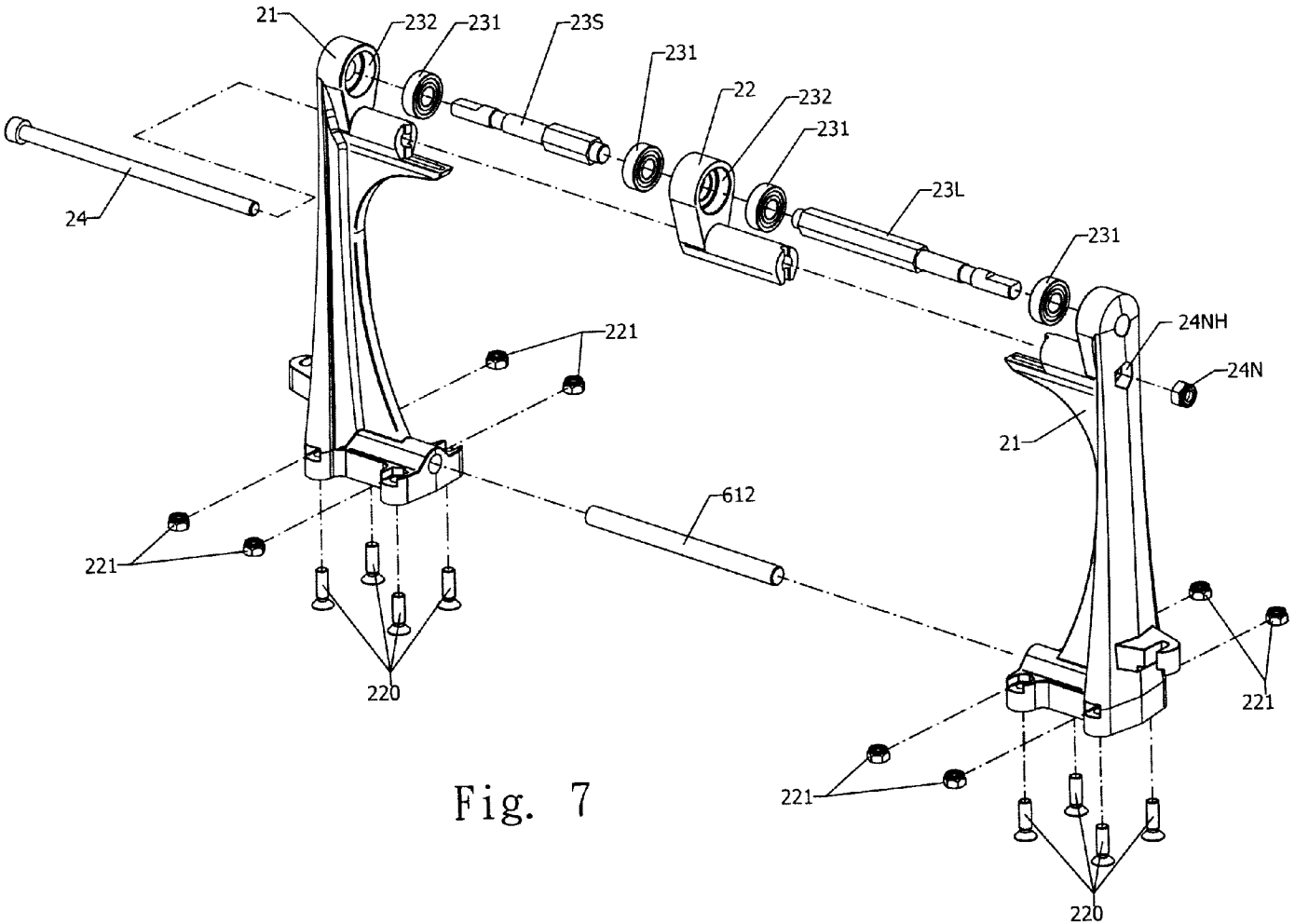
Figure 7A:
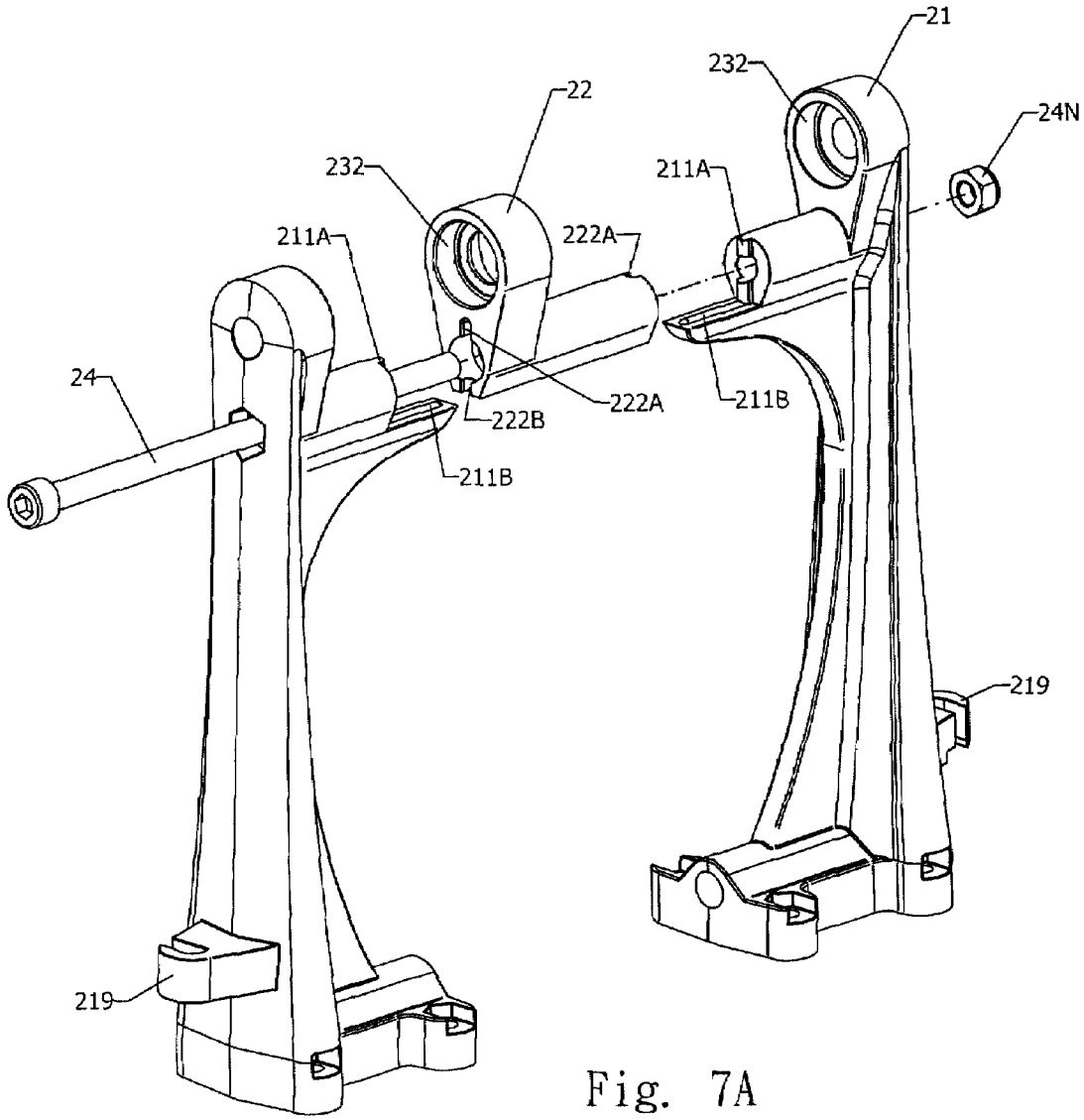
Figure 8:
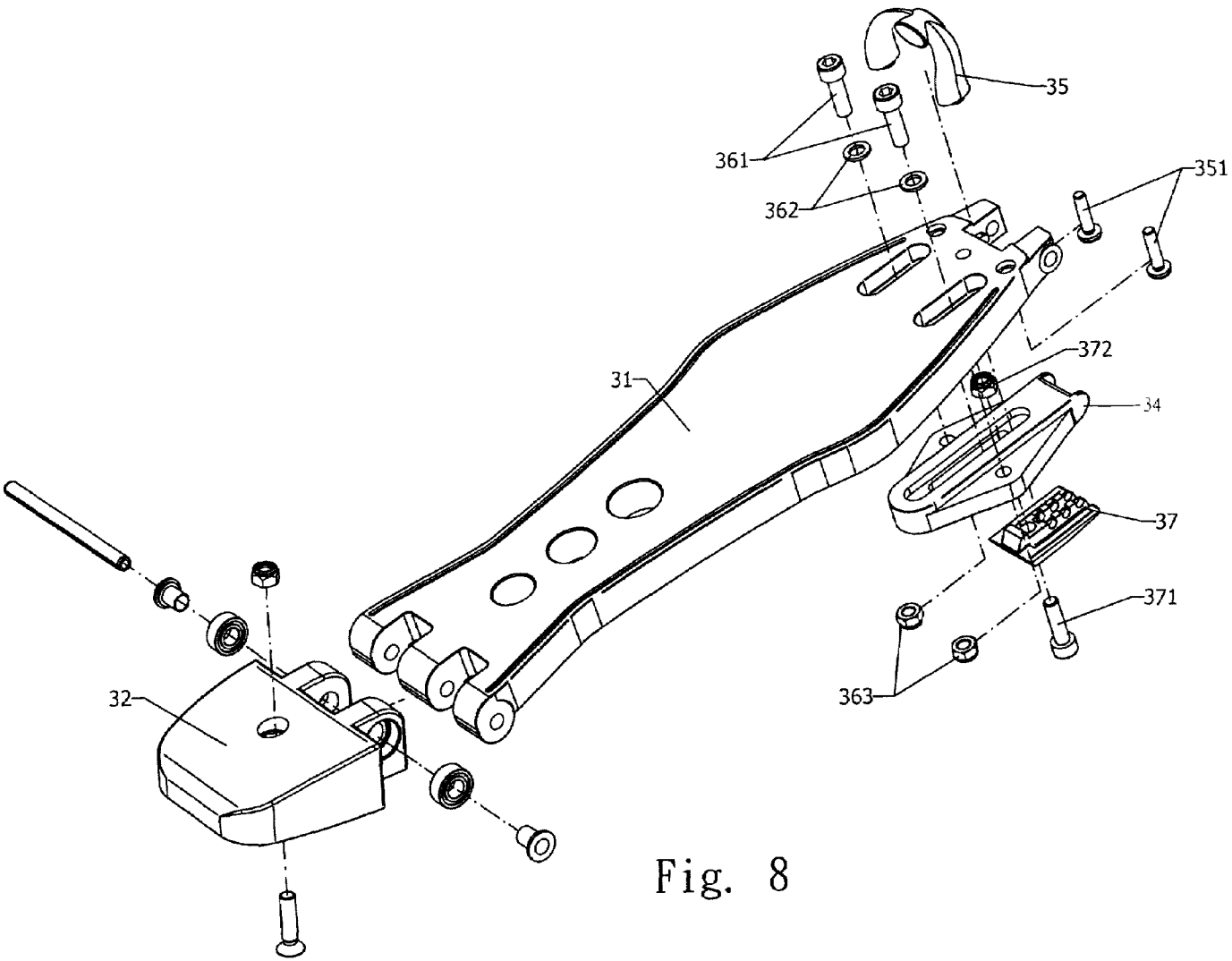
Figure 9A:
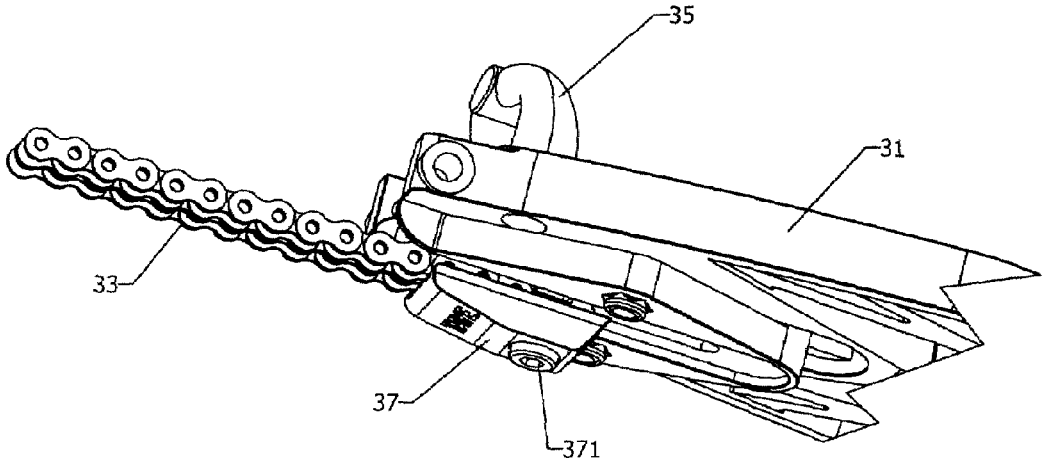
Figure 9B:
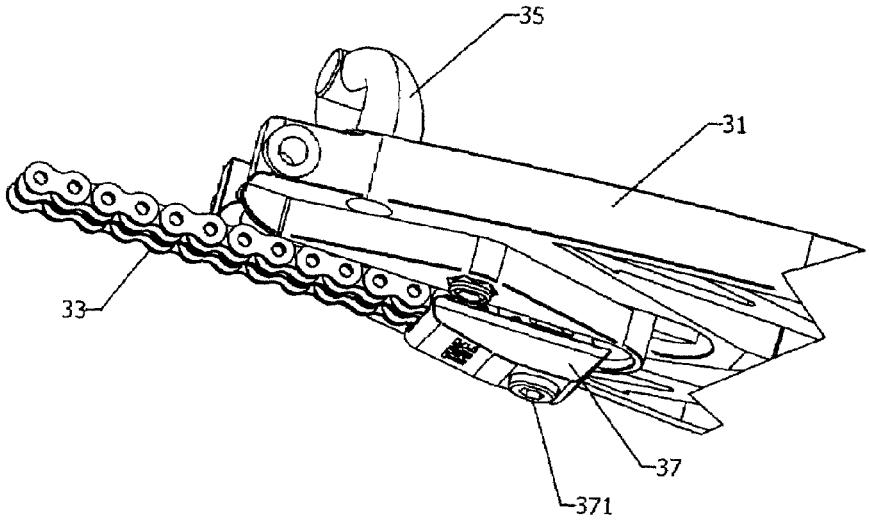
Figure 10A:
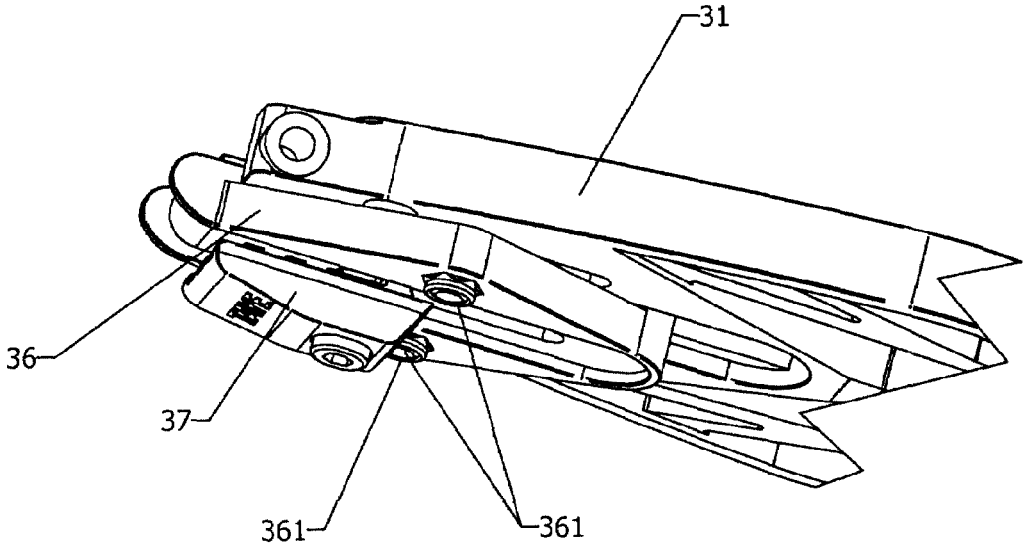
Figure 10B:
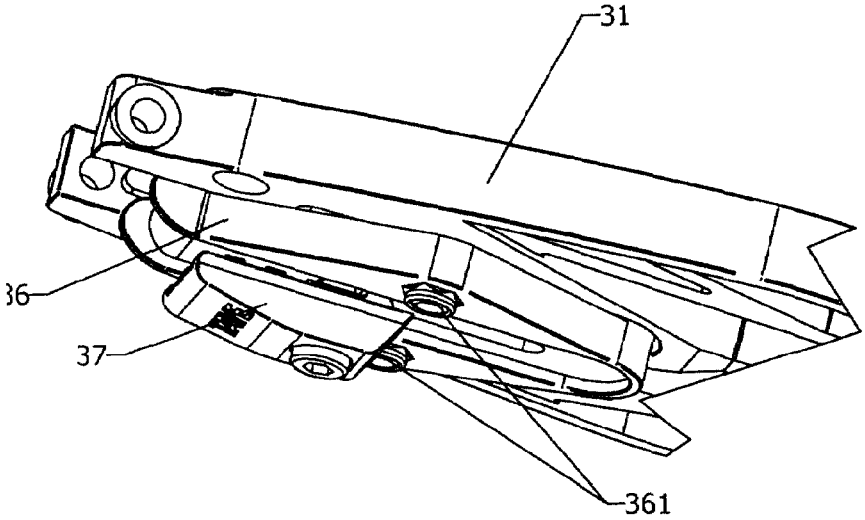
Figure 11A:
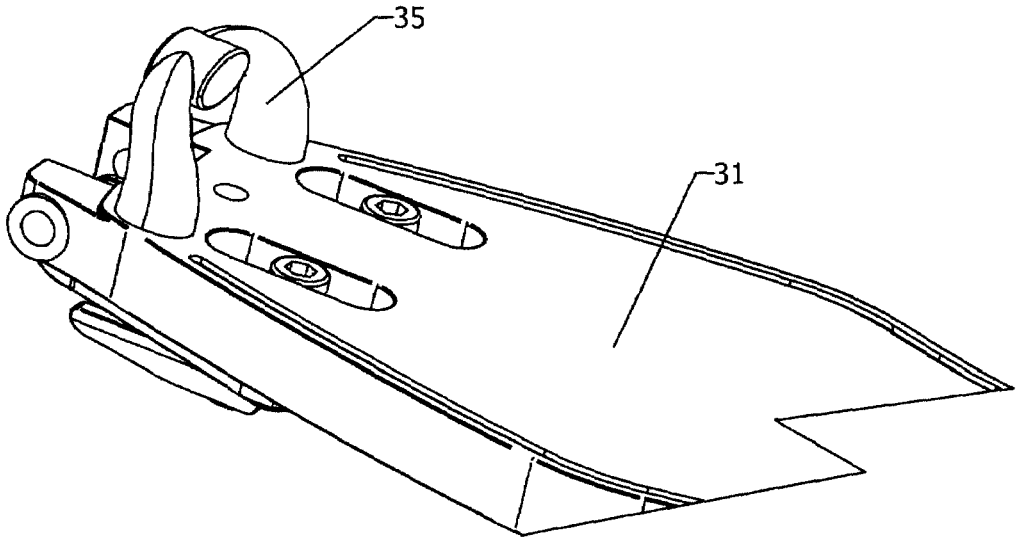
Figure 11B:
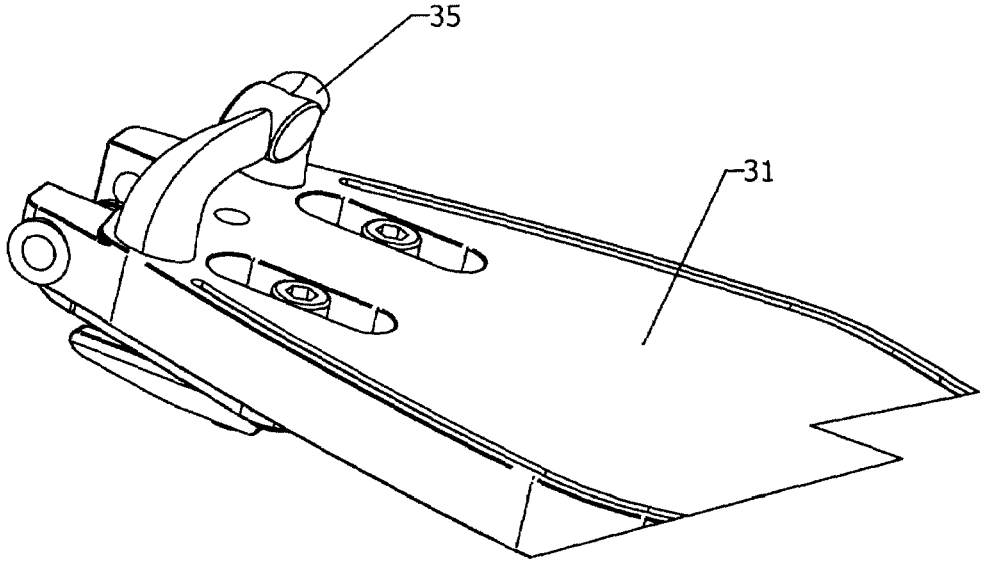
Figure 12:
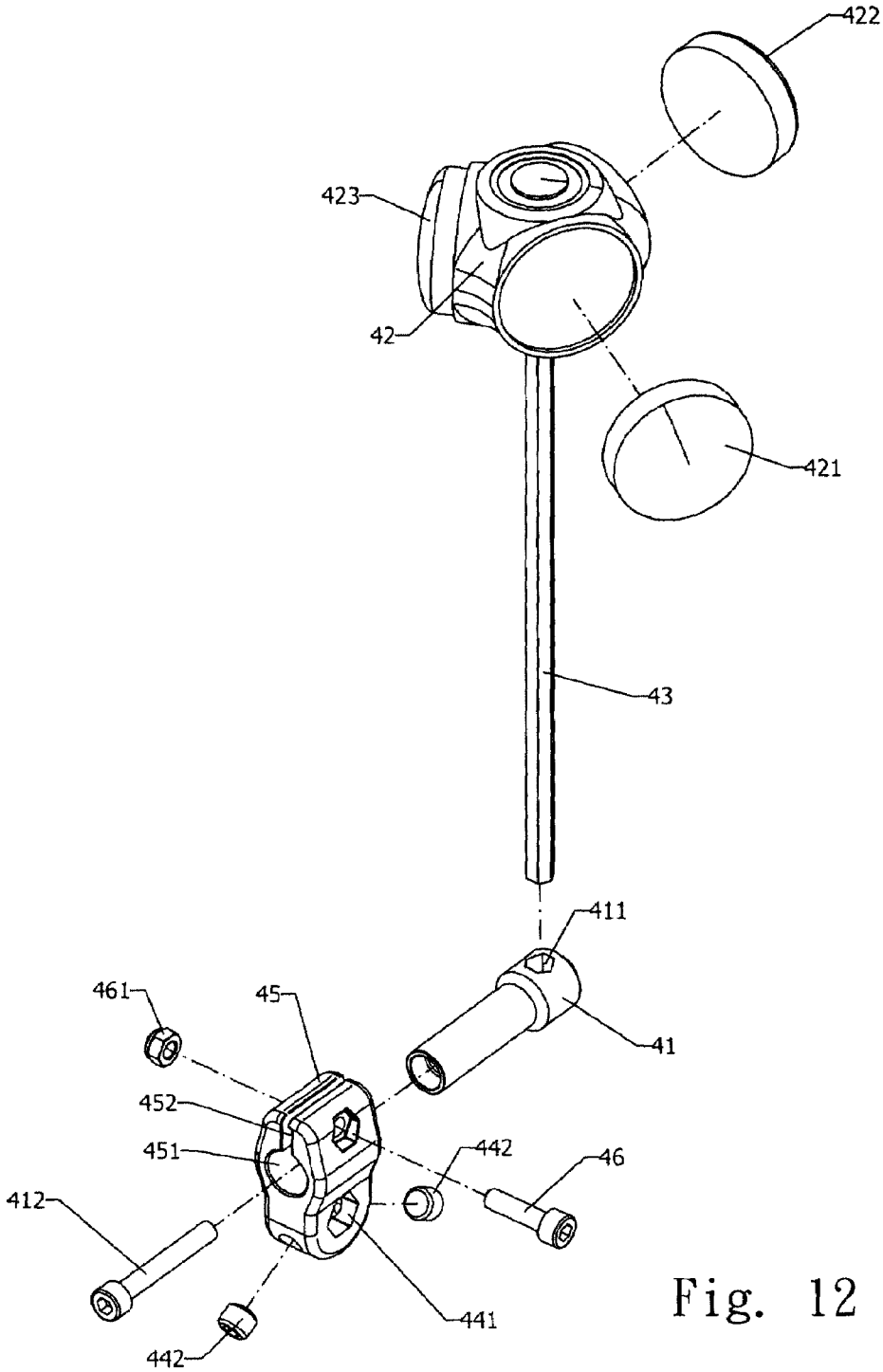
Figure 13B:
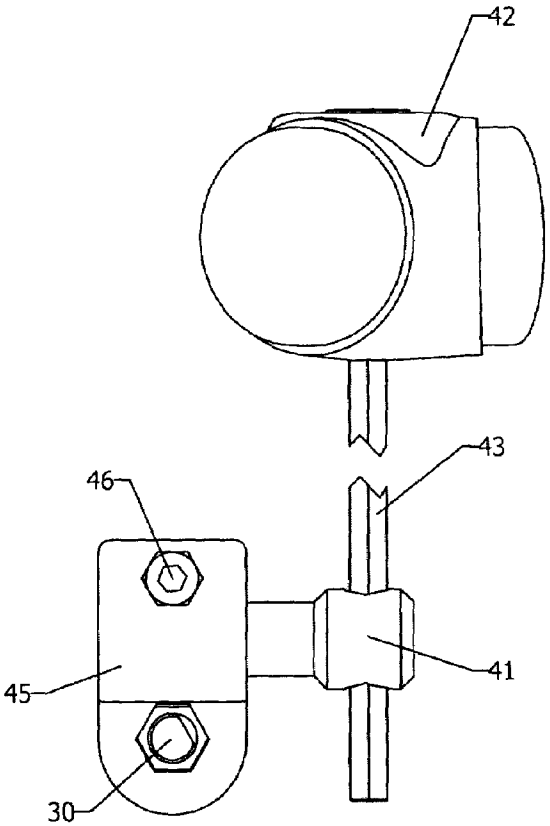
Figure 13A:
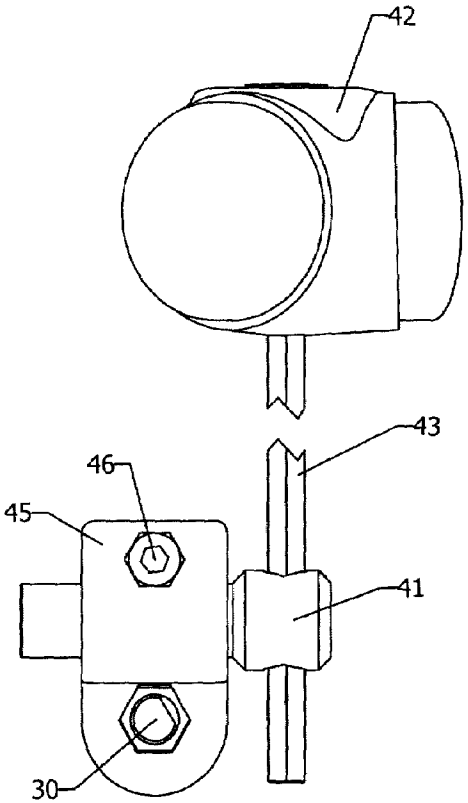
Figure 14:
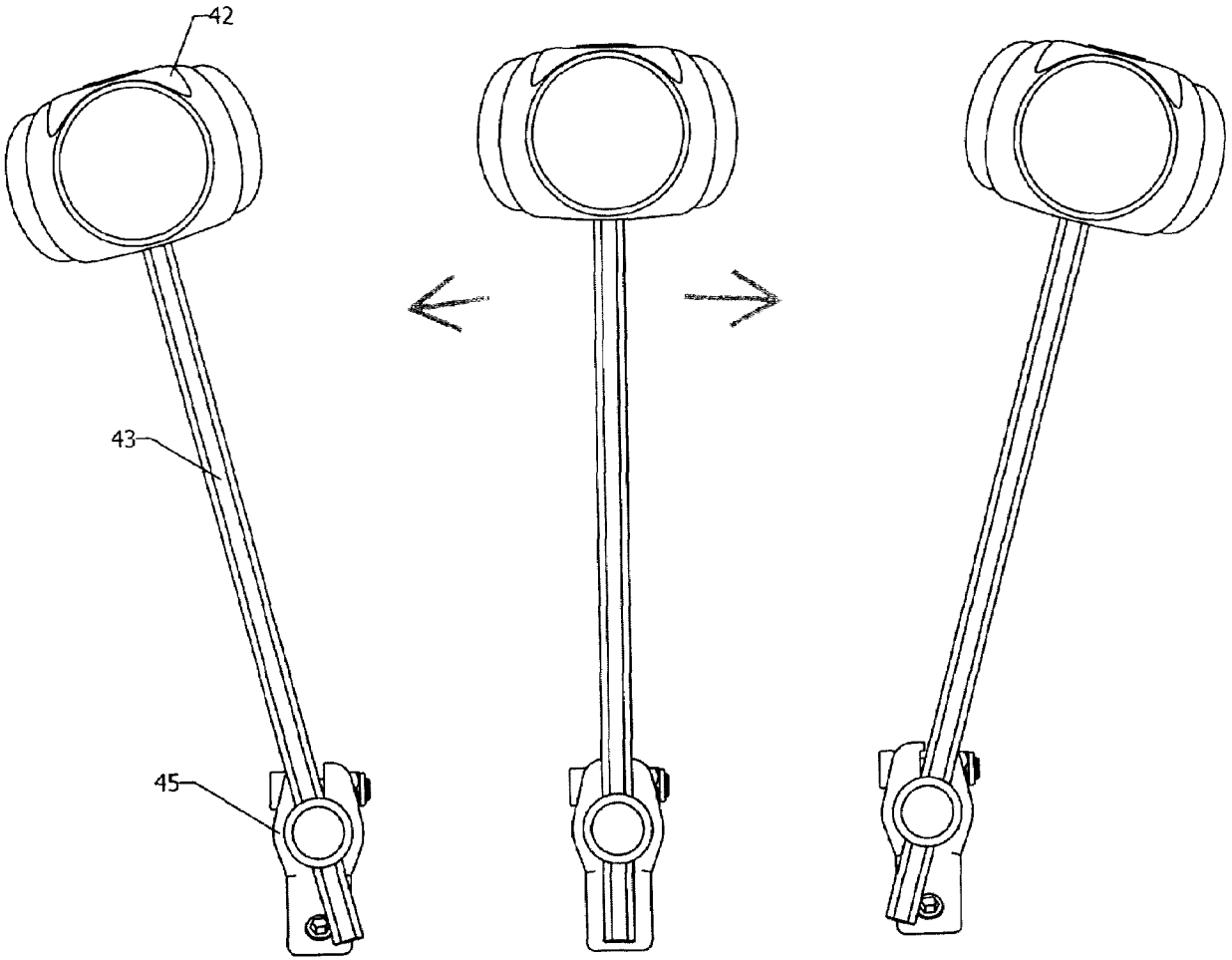
Figure 15A:
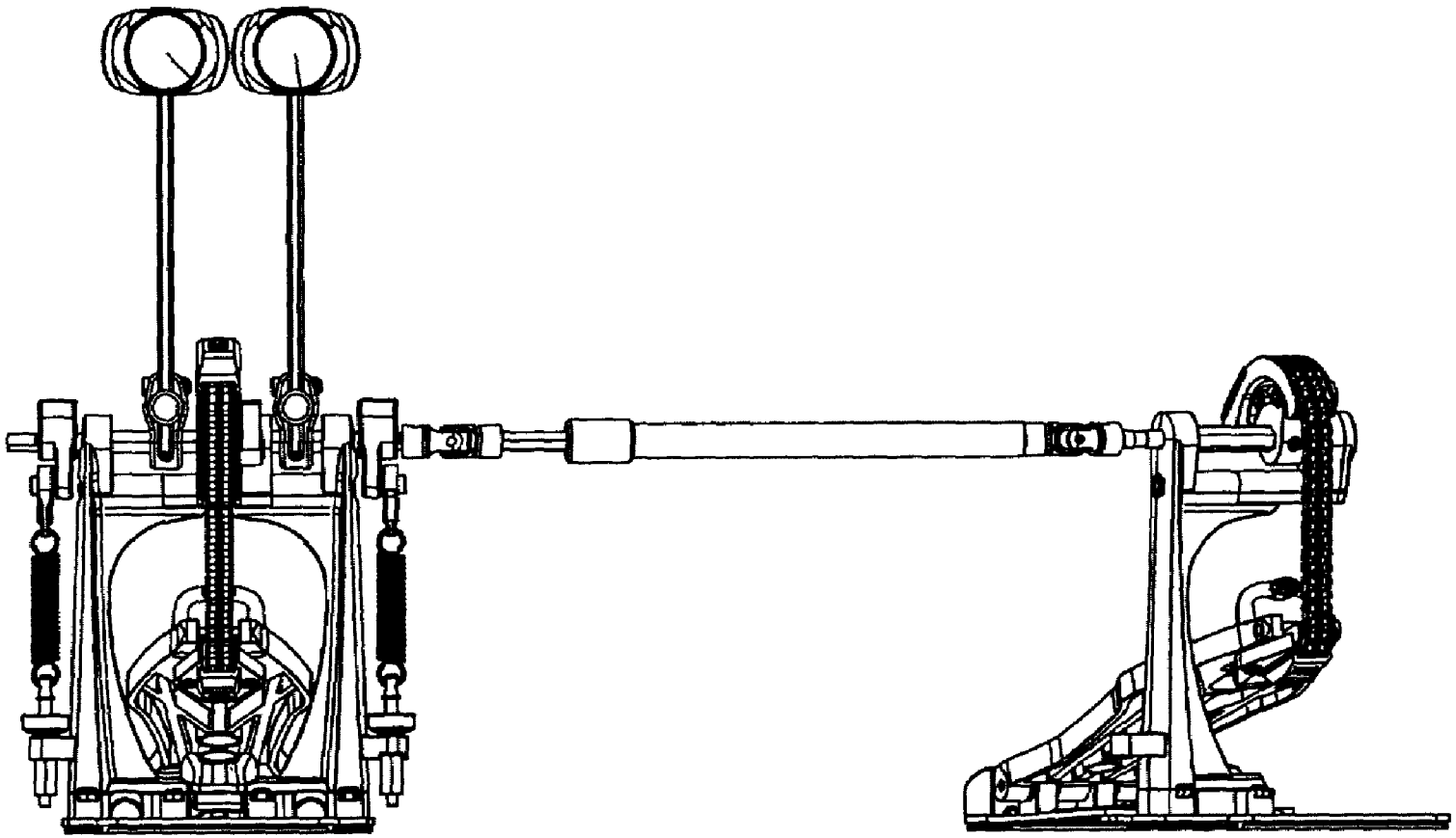
Figure 15C:
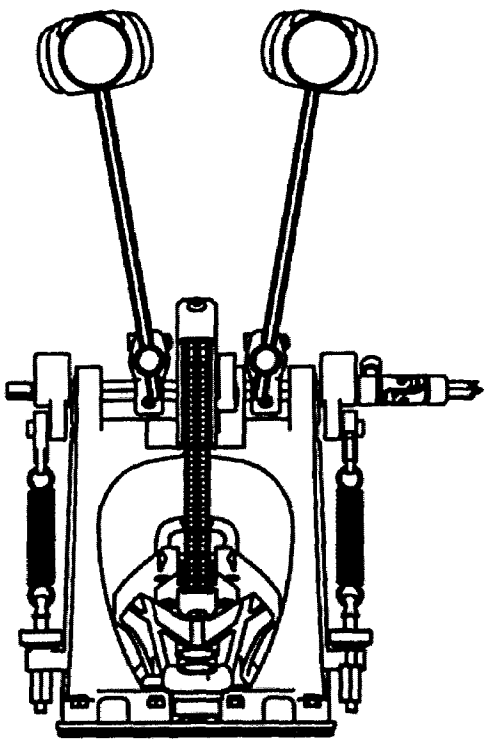
Figure 15B:
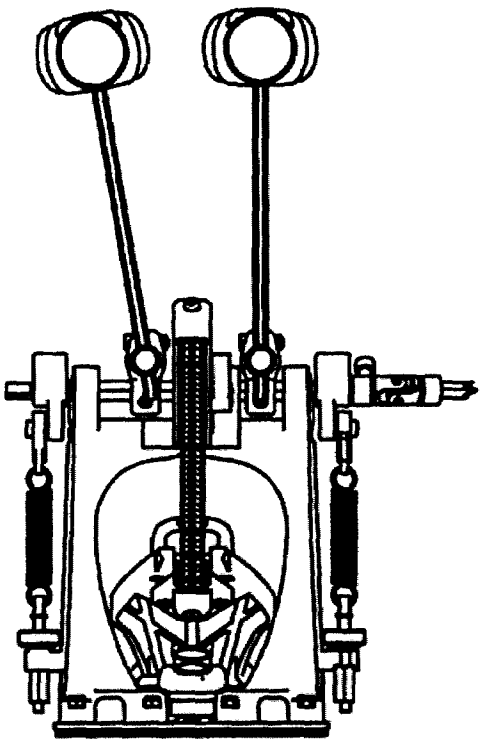
Figure 15E:
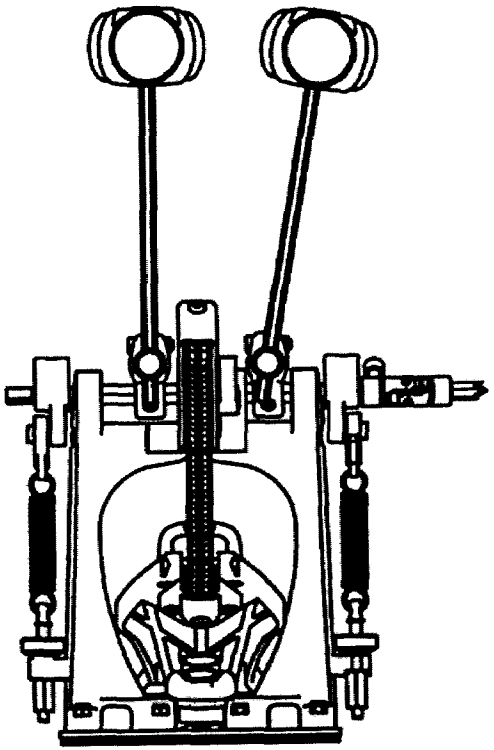
Figure 15D:
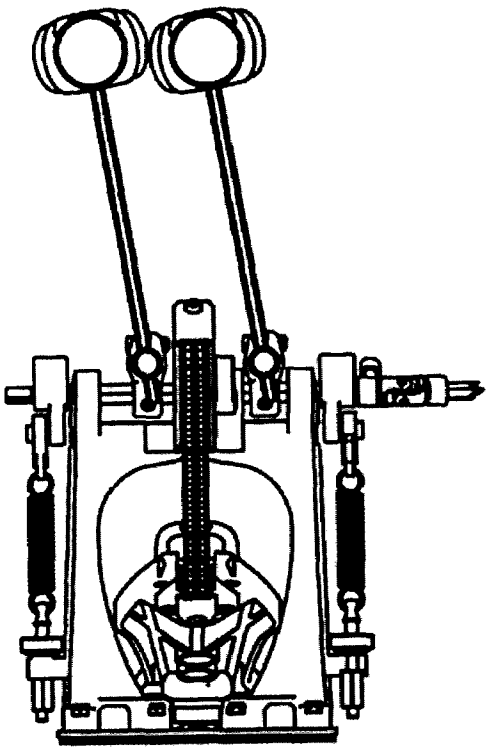
Figure 16:
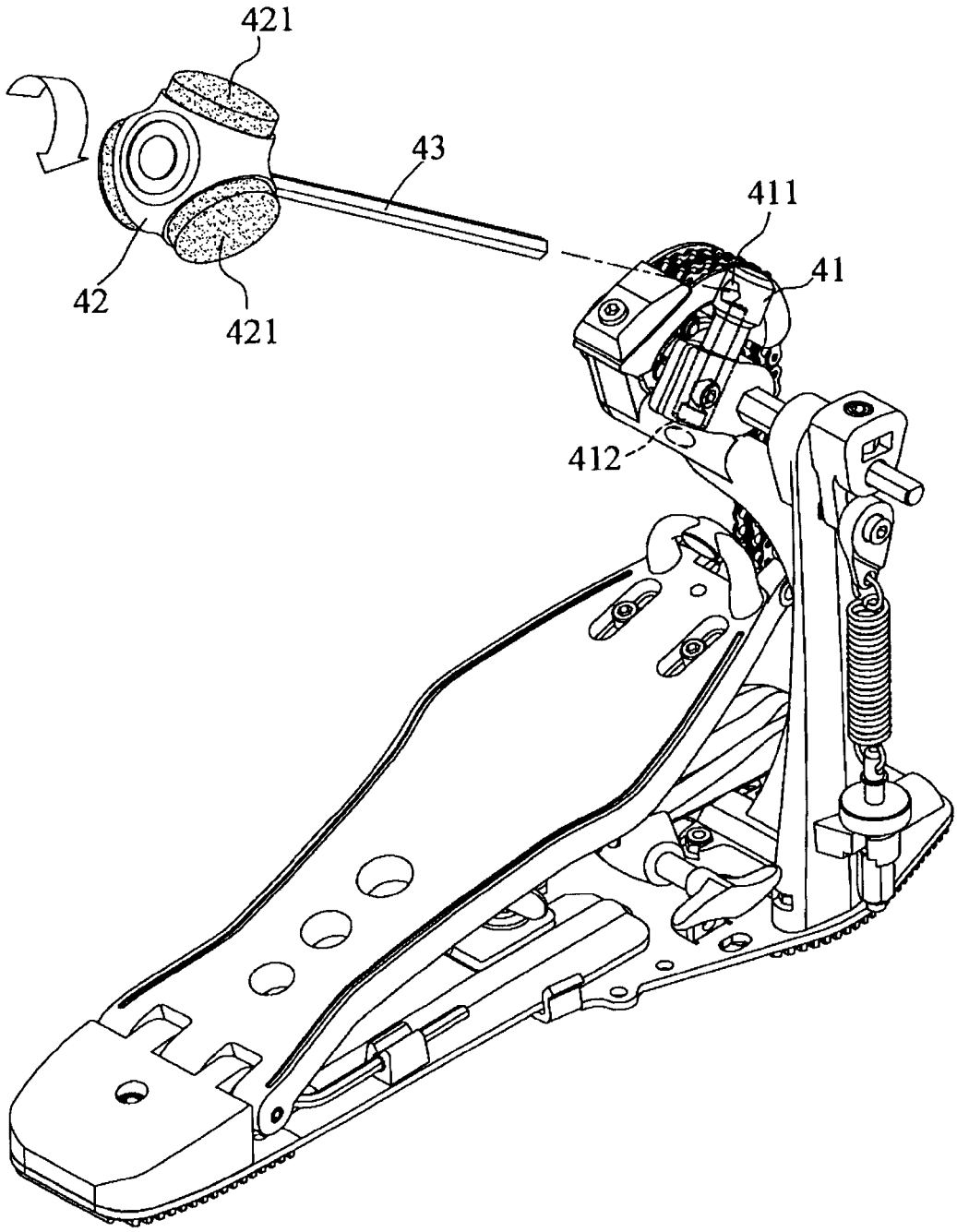
Figure 17:
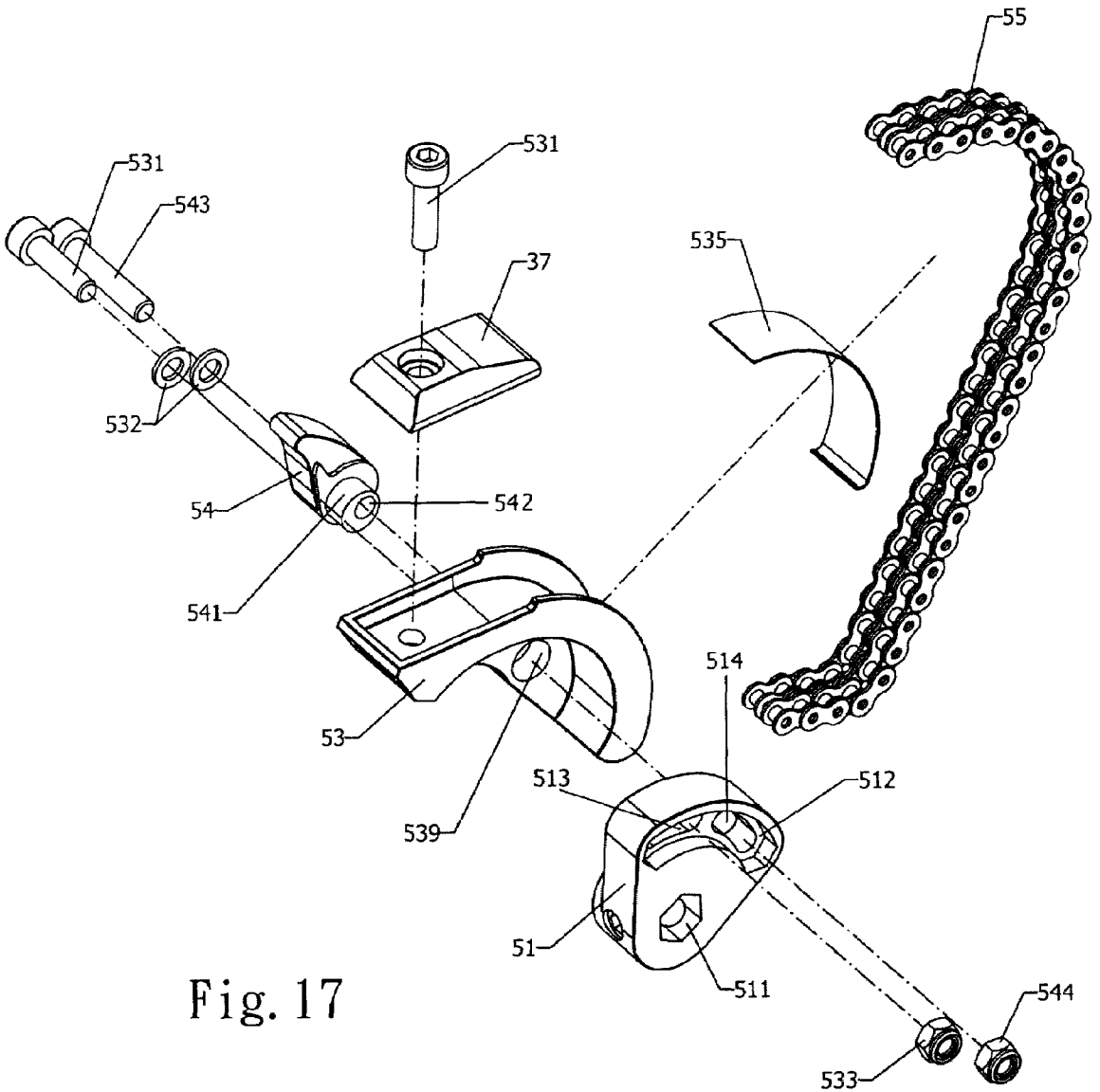
Figure 19A:
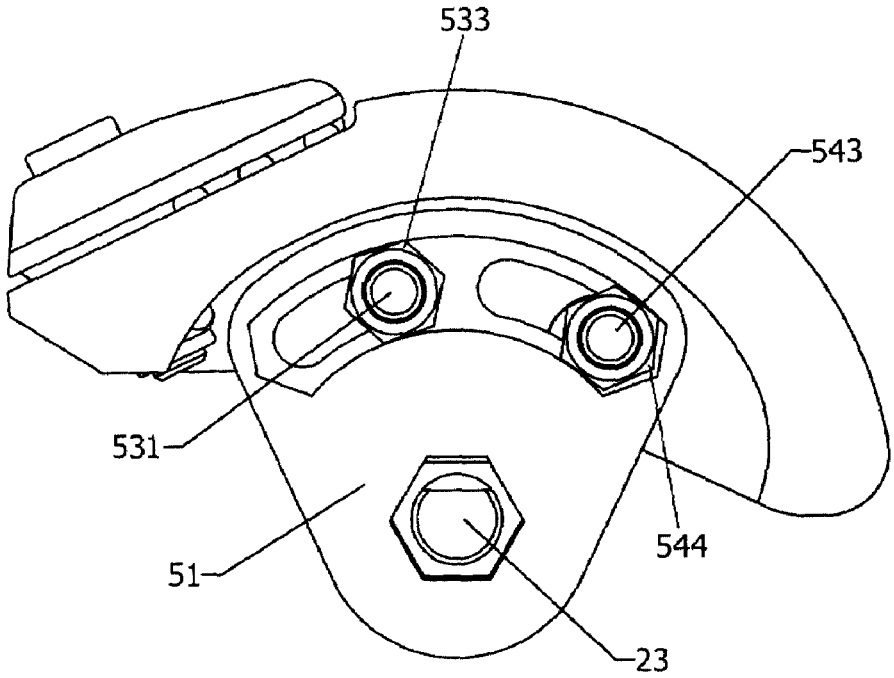
Figure 19B:
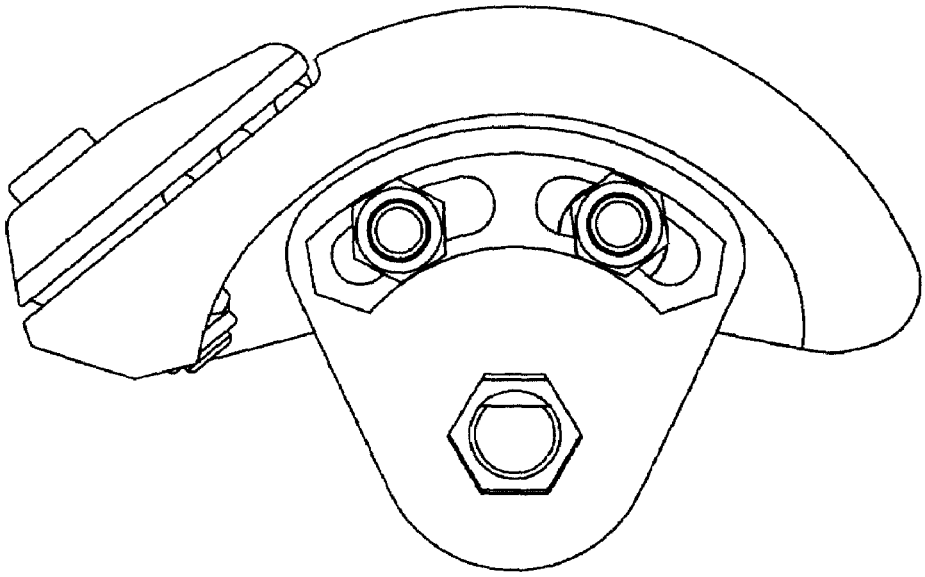
Figure 20:
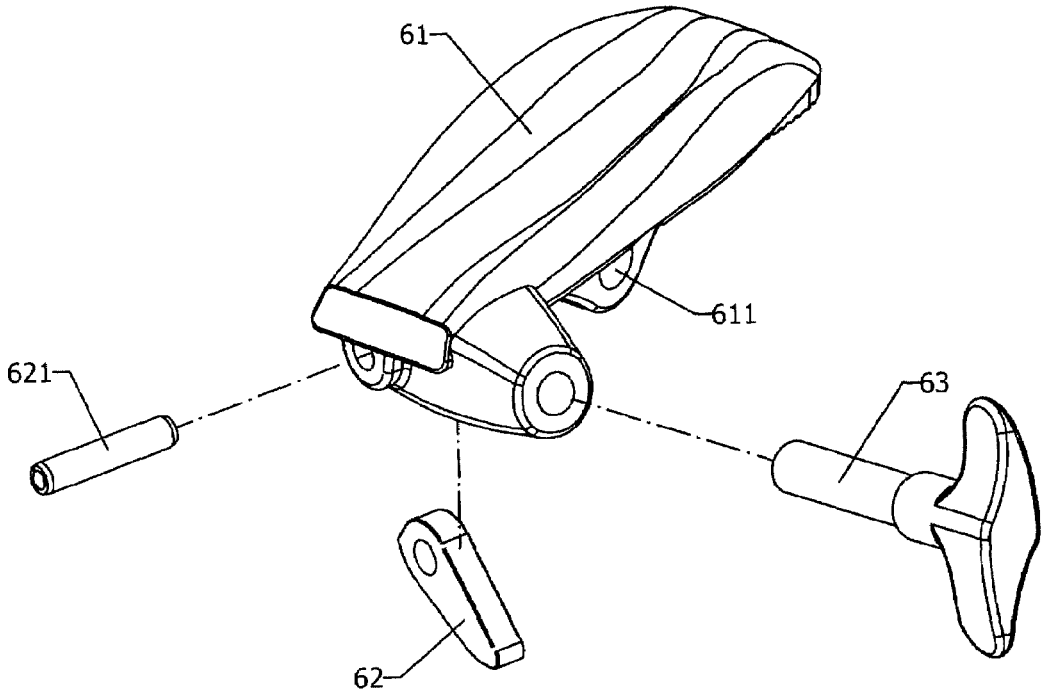
Figure 22:
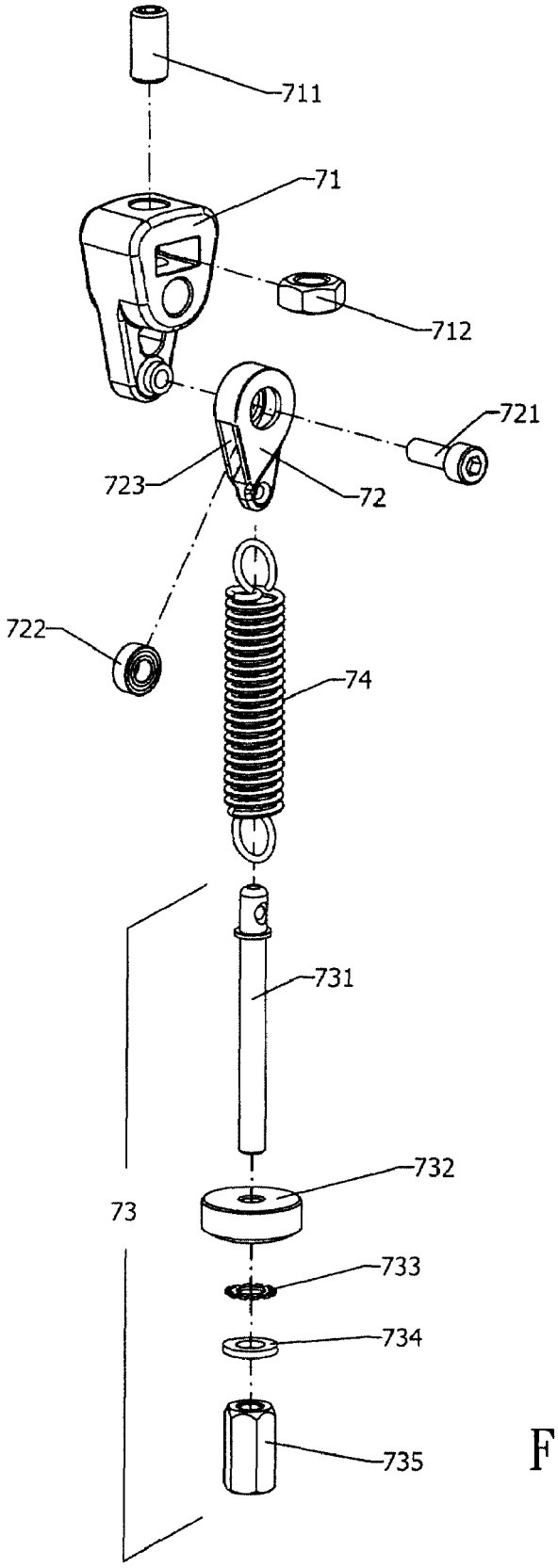

FIG. CC shows a conventional and common double beater pedal with single pillar secondary drive pedal and double pillar primary pedal;

FIG. 1 is a perspective view of the drum pedal with single-Tower single-beater assembly of the present invention. The single-Tower is attached to the right side of the base structure. This perspective is viewed from the operator's right side;

FIG. 2 is a perspective view of the drum pedal, as shown in FIG. 1.0, viewed from the operator's left side;

FIG. 2A is a perspective view of the drum pedal with the single-Tower single-beater assembly attached to the left side of the base structure, viewed from the operator's right;

FIG. 2B is a perspective view of the drum pedal with two one single-Tower assemblies mounted on the right side and a second Tower mounted on the left side. This shows a double-Tower pedal with one beater. It is viewed from operator's right;

FIG. 3 is an exploded perspective view of the single-tower single beater assembly, viewed from the operator's right side. This illustration serves to separate the various drum pedal elements including base assembly 10, single-Tower assembly 20, foot pedal assembly 30, drum beater assembly 40, drive transmission assembly 50, drum clamp assembly 60, and spring return assembly 70;

FIG. 4 is an exploded perspective view of the pedal base plate assembly showing front and read base plates and the base plate assembly unit;

FIG. 5 shows two side elevation views, FIGS. 5A and 5B, showing two adjustments of the pedal base plate, FIG. 5A in the shortened position and FIG. 5B in the lengthened position;

FIG. 6 is a perspective exploded view showing the single-Tower assembly including the Tower and Bearing Support Arm and the driveshaft assembly;

FIG. 7 is a perspective exploded view showing two Towers, one Bearing Support Arm, two driveshaft assemblies and the stabilizing rod assembly;

FIG. 7A is a perspective exploded view showing two Towers and one Bearing Support Arm, viewed from left-also shows stabilizing rod and assembly mating areas;

FIG. 8 is a perspective exploded view showing the foot pedal assembly including the heel plate and the Chain-Slider assembly;

FIG. 9 shows two perspective section views, FIGS. 9A and 9B, of foot pedal Chain-Slider and Chain-Anchors showing shortened chain position and lengthened chain positions;

FIG. 10 shows two partial perspective views, FIGS. 10A and 10B, showing the Chain-Slider without chain attached to illustrate shortened and lengthened pedal foot board positions;

FIG. 11 shows two partial perspective views of the reversible toe stop, FIGS. 11A and 11B, attached in two possible positions forward and reverse;

FIG. 12 shows an exploded perspective view of the beater assembly;

FIG. 13 shows two beater assembly side views, FIGS. 13A and 13B of beater adjustability fore and aft positions and beater height adjustment capability;

FIG. 14 shows 3 front elevation views of beater assembly showing rotatable and extendible adjustability side to side and up and down variable beater length and beater position;

FIG. 15 shows 5 illustrations, FIGS. 15A, 15B, 15C, 15D, 15E, all front elevations detailing views of the full double pedal assembly including FIG. 15A showing the one double-Tower primary pedal and one single-Tower drive pedal which comprise a double beater pedal with secondary pedal driven by operator's left foot, plus 4 views of various double beater relative position placements on primary two-Tower pedal;

FIG. 16 shows single-Tower pedal with the triple-head beater mounted on hex shaft with 3 choices of playing positions;

FIG. 17 shows an exploded perspective view of the eccentric cam drive transmission assembly with drive chain;

FIG. 18 shows several views, FIGS. 18A, 18B, 18C and 18D, of the eccentric cam adjust lever in various positions;

FIG. 19 shows two side elevation views of the eccentric adjust cam assembly in two positions viewed from the opposite side of cam adjust lever, FIGS. 19A and 19B;

FIG. 20 shows an exploded perspective view of the drum clamping assembly;

FIG. 21 shows 6 illustrations, FIGS. 21A, 21B, 21C, 21D, 21E and 21F, various views drum clamping assembly functionality;

FIG. 22 shows exploded perspective view of the spring return rocker assembly;

DETAILED DESCRIPTION OF THE PREFERRED EMBODIMENT

Referring to the drawings, wherein like features are denoted by corresponding reference numbers, the preferred embodiments of the inventions are thereby illustrated and described.

Referring to FIG. 3 the exploded perspective shows a drum pedal assembly illustrating the major components of the present invention which comprises a base-structure assembly 10; a single-Tower assembly 20 including drive-shaft, Bearing Support Arm and bearings, which attach to the base-structure assembly 10 in the right side position; an adjustable pedal board unit 30 including footboard, heel plate and toe-stop, an adjustable drum beater assembly 40; an adjustable drive transmission assembly 50 including cam and chain or strap; a drum clamping assembly 60; and a spring-actuated returning assembly 70.

Referring to FIG. 4 the base structure assembly 10 is composed of a front plate 11 and a rear plate 12 wherein the front plate 11 and the rear plate 12 have an overlapping section. A guide slot 14 is defined in one end of the rear plate 12 and a positioning bolt 144 extends through the front plate 11 and is movably engaged with the guide slot 14. A positioning pressure plate 143 is connected to the positioning bolt 144 so as to press the overlap portion of the front and rear plates 11 and 12 to position the front and rear plates 11 and 12. A handle nut 141 is connected to the screw section at the top of positioning bolt 144 and on top of the positioning pressure plate 143. The extended lip shape of positioning pressure plate 143 allows base rear plate 12 to be guide under pressure plate 143 for ease of engagement. Two parallel grooves 121 embossed in rear plate 12 and matching two parallel grooves 111 embossed in front plate 11 serve to guide rear plate 12 over front plate 11 so that alignment is ensured. The overall length of the pedal base-structure assembly 10 can thereby be adjusted and plate base-structure assembly 10 can be disassembled for pedal folding if so needed. Normally a pressure plate 143 is not seen to be used in similar applications in other pedals and only flat washer 142 is used. In that case a spring is necessary to separate washer 142 from plate parallel grooves 111. Separation of the washer 142 is necessary to allow rear plate 12 to slide over front plate 11 guided by bolt 144 and slot 14. Without a spring or plate 143 the operator would be required to lift the washer 142 by other means thereby making assembly and disassembly awkward. In this case, plate 143 automatically lifts washer 142 as rear plate 12 is guided past bolt 144 through slot 14.

Also shown in FIG. 4 in rear plate 12 there are the 2 sets of 4-hole groupings 11-4R and 11-4L which serve to accept the 4 bolts for the single-Tower to attach to the front plate 11. A single-Tower mounted on the right side of the front plate 11 would use the 4-hole grouping 11-4R on the Right side of the front plate 11 and a single-Tower mounted on the left side of front plate 11 would use 4-hole grouping 11-4L on the Left side of front plate 11. Mounting 2 Towers upon one front plate 11 would require using both 4-hole groupings 11-4R and 11-4L. There are 6 holes in front plate 11 all numbered 112. They serve to attach individually or severally accessory connector plates not shown, which, for one example would allow the connecting together of two or more base plate structures or ancillary base plates. The overall length of base-structure assembly 10 can be lengthened or shortened by loosening nut 141, pulling apart or pushing together plates 11 and 12, which would slide upon the embossed grooves 121 on rear plate 12 and embossed grooves 111 on front plate 11. Once the desired length is achieved the position is secured by tightening nut 141. Additionally, rear plate 12 can be disengaged completely from front plate 11 in order to facilitate the folding and compacting of the pedal assembly for travel and or storage. Reassembly is simplified in guiding rear plate 12 using slot 14 to engage and mate with bolt 144 slipping the front end of rear plate 12 between pressure plate 143 and front plate 11, thereby lifting the loosened pressure plate 143. This way the adjustment of length of base-structure assembly 10 is facilitated.

FIG. 5 shows two side-elevation views of the complete single-Beater single-Tower pedal. The top figure shows FIG. 5A shows the base-structure assembly 10 in the shortened position and the resulting footboard unit 30 is positioned forward. The lower FIG. 5B shows the base-structure 10 in its lengthened position showing the resulting footboard unit 30 is positioned rearward, and the drive chain 33 as a result has moved from a perpendicular resting position to an angular resting position. Adjusting the length of the footplate adjusts the position of the pedal footboard and results in adjusting the angle of the drive chain 33. Also seen clearly in FIG. 5 is a side view of the drum clamping assembly 60. Also shown in the side elevations are nut 141 and pressure plate 143. Rear plate 12 is pressed between pressure plate 143 and front plate 11 by engaging and turning nut 141.

The Tower 20, see FIG. 6 connects to the top of the base-structure assembly 10 at one set of the positioning holes, see FIG. 4, either the set of 4 holes 11-4L for Left mount or the set of 4 holes 11-4R for Right mount defined through the front plate 11 located on either the right or the left side of front plate 11 using, see FIG. 6, the set of 4 bolts 22-4 and the set of 4 nuts 22HN-4. The single-Tower assembly 20 is also shown in FIG. 3 attaching to base-structure assembly 10 on the right side of front plate 11. The tower 21 is attached to bearing support 22 using stabilizer rod 24 screwed into nut 24N which is set into hex hole 24NH which is cast into the upper side of tower 21. Tower 21 has an assembly section 211 which consists of a vertical laterally protruding ridge 211A and a horizontal vertically protruding ridge 211B. Bearing support 22 has a mounting section 222 with a vertical inset groove 222A and horizontal inset groove on the underside 222B. The attaching of Tower 21 to support 22 involves mating ridge 211A with groove 222A and ridge 211B with groove 222B. This mating of ridges and grooves assures a solid connection that will ensure the resisting of twisting and turning of tower 21 and support 22. The tower has a round flat bottom cavity that accepts bearing 231 and likewise support 22 has a matching cavity to accept a matching bearing 231. These two bearings support drive shaft 23L which is captured between Tower 21 and bearing support 22. This is a unique design solution to installing a drive shaft and bearings. Normally bearings need to be secured by press fitting or secondary screw pressure, adding costs and also adding to the possibility of compromised performance of the bearings. This method of bearing and driveshaft assembly is a direct result and is intended as one of the preferred embodiments of the System. It is noted that the symmetrical Tower 20 can be connected to right side or left side of the front plate 11.

The driveshaft transmission assembly 23 has a drive shaft 23L if long and 23S (shown in FIG. 7) if short which may have a hexagonal or circular or partly circular and partly flat cross section, and is attached to a foot pedal plate 31 (shown in FIG. 8) The driveshaft transmission assembly 23 is rotatably connected between the Tower 21 and the support 22 with two bearings 231 mounted on two ends of the driveshaft 23. The two bearings 231 are respectively connected to the at least one Tower 20 and the support 22.

The pedal board unit 30 in FIG. 8 to 11 shows pedal board unit 30 including foot pedal plate 31, heel plate 32, drive chain 33, toe stop 35, chain set 36 and chain cap 37, the foot pedal plate 31 is pivotally connected to the base structure assembly 10 at heel plate 32 and is able to drive the foot pedal plate 31 to rotate. toe stop 35 screw on the front of foot pedal plate by two screws 351, to prove the toe can't over the foot pedal plate 31. chain set had fit in the front under of foot pedal plate 31 by bolts 361,362 and nut 363, to connected the chain 55 by chain cap 37 by blot 371 and nut 372, the chain set 36 can adjusting the position of chain 55.

The beater assembly 40 in FIG. 12 is driven by the drive transmission assembly 50 and is co-rotated with the pedal board unit 30. The beater assembly 40 shows in FIG. 12 has a beater holder 41 which is connected to a clamp member 45 and movably connected to the driveshaft 23L or 23S. The clamp member (beater clamp) 45 has a passage 441 through which the driveshaft 23L or 23S securely extends so that the clamp member 45 is co-rotated with the driveshaft 23L or 23S. The clamp member 45 further has a clamp portion 451 which includes a slot 452 (the slot 452 is the open end or the clamping device) so as to define two parts, and the beater holder 41 is located in the clamp portion 451, a bolt 46 extends through the clamp portion 451 to squeeze the two sides of slot 452 to clamp the beater holder 41 in the clamp portion 451. Two urging crews 442 are threadedly connected to the clamp member 45 and contact against the driveshaft 23L or 23S so that the clamp member 45 is securely connected to the driveshaft 23L or 23S. A polygonal engaging hole 411 is defined through the beater holder 41 and a beater 42 has a beater shaft rod 43 which is engaged with the polygonal engaging hole 411. The beater shaft rod 43 has a hexagonal cross section and the polygonal engaging hole 411 is a polygonal six-sided hole. A positioning bolt 412 extends from an underside of the beater clamp 45 to contact against and position the connection rod 41. The beater 42 has a plurality of beat faces 421 which are located on an outer periphery of the beater 42. The number of the beat faces can be one or two or three or any number and the cross section of the beater shaft rod 43 and the shape of the engaging hole 411 can also be rectangular or round or oval. The beater 42 shown in cooperation with the hexagonally shaped beater shaft rod 43 and 6-sided hole 411 conspire to provide 3 secure beater beating positions. The beater faces 421, 422 and 423 can be made of different materials such as wood, plastic, metal, felt or cork. These different materials provide a different sound when the beater strikes the drum. Beater faces shown, 421 and 422 are attached to beater 42. Beater face 423 is moulded as part of beater 42. The hexagon shape beater shaft rod 43 is aligned with three beater faces 421, 422, and 423 on beater 42 provide three beater face choices for the operator. Additionally, the hexagon shape of the beater shaft rod 43 engaged in the six-sided polygonal shaped hole 411 in beater holder 41 assists in preventing twisting of beater face during operation. The twisting of the beater face during operation is a problem encountered by multifaceted drum beaters with round shaped shafts. Ineffective locking devices have been tried but are not secure enough. The hexagonally shaped beater shaft rod 43 fitting into six side hole 411 is another preferred embodiment of this invention. Another function of the beater clamp 45 is to allow rotational adjustment for beater 42 and fore and aft adjustment for beater 42 because beater holder 41 is positionable lengthwise in the clamping portion 451. These features, both the rotational and fore-and-aft adjustability of the beater 42 are provided by the invention and design of beater clamp 45 are preferred embodiments of the invention. Lateral adjustment of the beater clamp 45 on driveshaft 23L or 23S is also a feature of the design. FIG. 13 shows two drawings FIGS. 13A and 13B, which serve to further illustrate the fore and aft adjustability of beater holder 41 in beater clamp 45. FIG. 13A shows beater is positioned "aft" in clamp 45 and FIG. 13B shows beater is positioned "fore" in beater clamp 45. The "fore" and "aft" positions dramatically change the feel of the pedal because the leverage of the beater relative to the rotating centre of the drive shaft is changed. The operator if offered an easy way to adjust this aspect of the pedal feel. FIG. 14 shows three examples of beater 42 positions provided by the clamp 45 adjustability. The view of elevation in FIG. 14 is on the same plane as the drum head membrane. This means the operator can choose with precision the area of the drum head being struck by the beater 42. This is another important embodiment of the invention which is not found in existing prior art. More possibilities adjusting double beaters are shown in FIG. 15. There are five drawings in FIG. 15. These drawings show the advantage of independently adjustable beaters whereby the beater head can be adjusted individually to that the beaters can be set to strike the drum head equidistantly by the double beaters. Also, the beaters can be set to strike differing lengths of distance from the centre of the drum. This is a choice of adjustment that is not found in other pedal systems and is one of the preferred embodiments of this pedal system. FIG. 15A shows a double pedal, in front elevation view, with two beaters set to strike the drum head equidistantly from the centre of the drum head. In this case the beaters could be set to strike any areas of choice. FIGS. 15B, 15C, 15D and 15E show beater striking patterns that suggest only a few of the possible choices offered the operator. For example, the operator may choose to have the one beater head strike very close to the centre of the head and the second beater to strike further away, creating two entirely different sounds. As well, two beaters striking equidistantly should create very similar sounding beats.

Figure 18A:
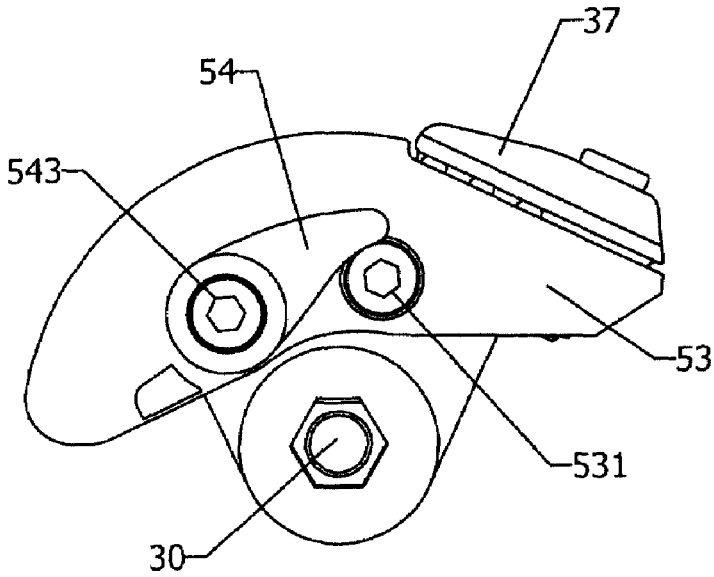
Figure 18B:
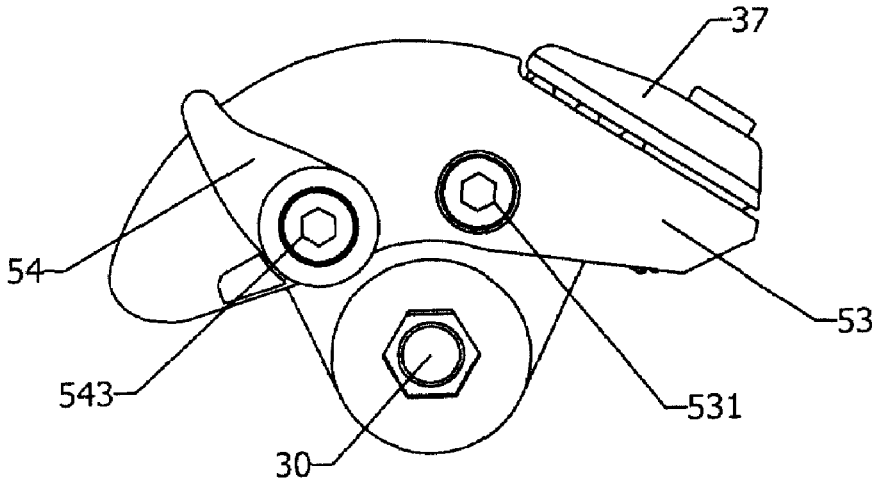
Figure 18C:
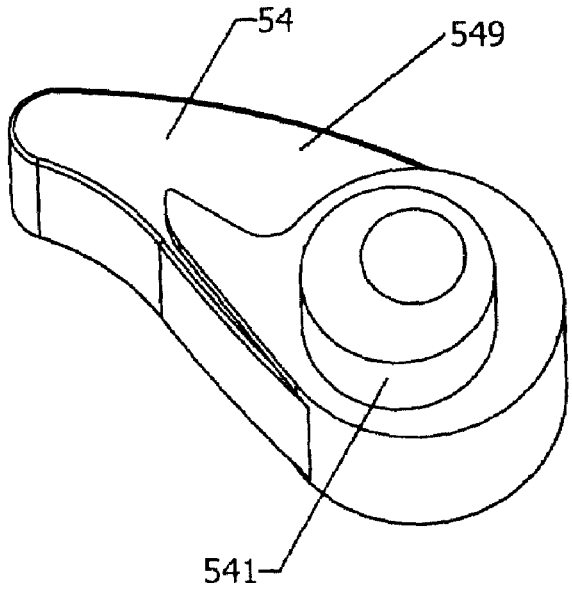
Figure 18D:
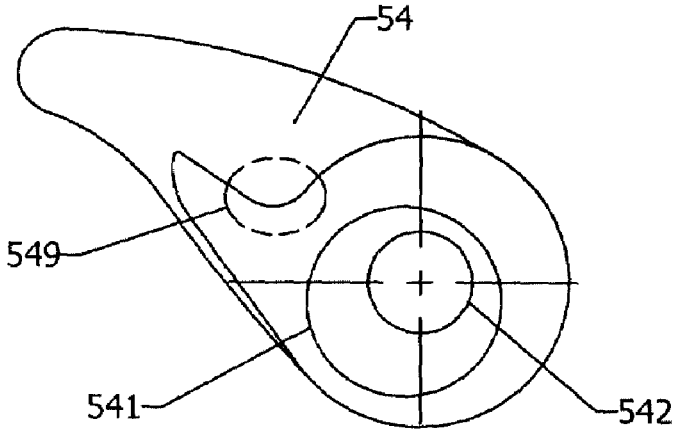

The drive transmission assembly 50 is connected between the driveshaft 23L or 23S and a chain 55 which is moved by the drive transmission assembly 50 so as to affect the height of the foot pedal plate 31, and the position the beater assembly 40. FIG. 17 shows the drive transmission assembly 50, which includes an eccentric cam hub 51 which is connected to the drive shaft 23L or 23S. two elongate holes, slots 513 and 514 are defined through the front face of the cam hub 51. The back of the cam has one longer elongate slotted hole 512. The eccentric cam 53 serves to support and attach either a chain 55 or a drive strap. The cam 53 is movably connected to the one of the elongate holes 512 of the cam hub 51 and the chain 55 has one end fixed to the cam 53 fixed by chain cap 37 and the other end of the chain 55 is connected to the foot pedal plate 31. An adjusting teardrop shaped knob (cam lever) 54 with a protruding stud 541 with an eccentrically placed off-centre hole 542 (show in FIG. 18) is connected through the cam lever hole 539 fashioned in cam 53, A bolt 543 extends through the cam lever hole 539 and another elongate hole 512 in the cam hub 51, and the cam lever 54 has an outer periphery on stud 541 which is rotated eccentrically as a result of the hole 512 being placed off centre. See FIG. 17. Bolt 543 passes through washer 532 and cam lever 54 through hole 542 and is fixed at the screw end with nut 544 which fits into one end of hole 512 fixed into the back of eccentric cam hub 51. A second bolt 531 is fitted parallel to bolt 543 but passes through washer 532 and bypasses cam 53 and passes through slot 513 on front of cam hub 51 and is fixed at the screw end with nut 533 which is fitted into the opposite end of slot 512, opposite from bolt 543 nut 544. When pressure on both bolts 543 and 531 is relieved the lever 54 can be rotated thereby lifting or dropping eccentrically the position of the cam over the hub. This adjustment is rotational on a curve and infinite in positions. Once desired position is achieved this position is locked in place by applying pressure on the assembly by simply turning bolts 543 and 531. The effect of changing the relative position of the cam can change not only the position of the pedal footboard and the pedal beater but can also change the feel of the beater motion of the pedal. As the arc is affected by the eccentric motion of the cam the effect is to either accelerate or decelerate the speed at which the beater is impelled toward the drum head. This eccentric cam lever 54 adjusting cam 53 mounted on eccentric cam hub 51 is a new and unique way to adjust the stroke of a bass drum pedal and is one of the preferred embodiments of this invention. FIG. 17 is a drawing showing an exploded view of the drive transmission assembly 50, featuring eccentric cam adjustability. FIG. 18 shows 4 drawings 18A, 18B, 18C and 18D. FIG. 18A shows the cam lever 54 adjusted in its down position. FIG. 18B shows cam lever 54 adjusted in its up most position. FIG. 18C is a perspective view of cam lever 54 showing the function area 549 that engages the cam lever stud 541. Another view shown in FIG. 18D shows a side elevation detailing the function area 549 that engages the cam lever stud 541 and the hole 542 place off-centre the cam lever stud 541. This shows graphically the function of the cam lever 54 lifting and dropping the cam 53. Additional drawings in FIG. 19A and FIG. 19B show the back side of the eccentric hub and the relative positions of the nut 533 attached to cam anchor bolt 531 and nut 544 attached to cam lever bolt 543. The smoothness of the curved shapes serves to make adjustment steps smooth and infinite.

The spring-actuated return assembly (spring return) 70 shows in FIG. 3 and FIG. 6 and FIG. 16. and the spring-actuated return assembly 70 show in FIG. 22 has one end connected to the Tower 20 at the bracketed protrusion 219 show in FIG. 6 and the other end of the spring return 70 is connected to the drive transmission assembly 50 so as to return the drive transmission assembly 50 and the beater assembly 40 to their initial positions. The spring return 70 includes a first frame (spring rocker body) 71 connected to the driveshaft 23L or 23S and a second frame (spring bearing hanger) 72 which is rotatably connected to the spring rocker body 71 by a bearing 722. A spring anchor assembly 73 is connected to the Tower 20 at slotted protrusion 219 and an extension spring 74 has one end connected to the spring anchor assembly 73 and the other end of the spring 74 is connected to the spring bearing hanger 72. It is the spring bearing hanger 72 which is the focus of the preferred embodiment in the spring return assembly 70. The bearing 722 is inserted into spring bearing hanger 72 which is cast in such a fashion as to allow the bearing to centre itself in the bottom of the casting without the internal turning area of the bearing to be impeding. The result is a completely unimpeded bearing which allows the bearing to perform without the friction that normal pedal designs inflict. This bearing holder, the spring bearing hanger 72 is monolithic in that is cast easily in one piece. Prior art shows capturing a bearing using two or more machined or cast pieces. The spring return 70 is rotationally adjusted and position on the end of the driveshaft 23L or 23S using screw 711 and nut 712 which is captured in a slot cast into the side of spring rocker body 71. The spring bearing hanger 72 is attached to spring rocker body 71 with a threaded shaft 721 which passes through the captured bearing 722. The bearing 722 is dropped into the bearing hanger 72 through an obliquely positioned open slot 723. The spring return 70 can easily be disengaged from the tower body 21 because the anchor protrusion is slotted protrusion 219 and allows the spring anchor screw to be removed and attached without removing nut 735. The shape of this anchor hole is 6 sided and accepts the hex shaped nut 735 to be locked in place thereby preventing turning from vibration which in turn would cause the spring settings to loosen.

FIG. 2A shows the single-Tower assembly 20 mounted on the left side. This is the preferred configuration for driving a beater pedal from the left. The operator has the opportunity to choose the position of the single-Tower to be placed either on the left or the right according to the operator's choice or need.

FIG. 2B shows that the drum pedal assembly of the present invention can also include one base-structure assembly 10 with two vertical towers, extending connected together by one bearing support. Choice can be made to use a longer drive shaft passing through a bearingless support or the drive shaft can be attached only to long drive shaft on the side that is chose to attach the drive transmission assembly 50.

Figure 21A:
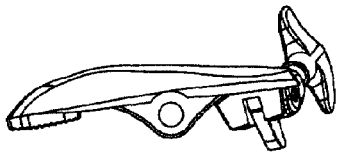
Figure 21B:
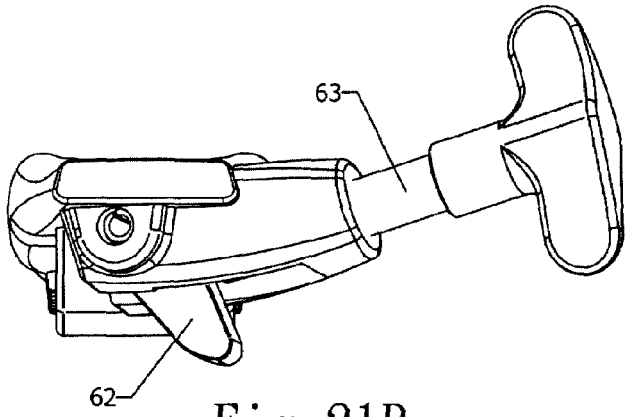
Figure 21C:
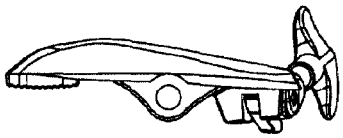
Figure 21D:
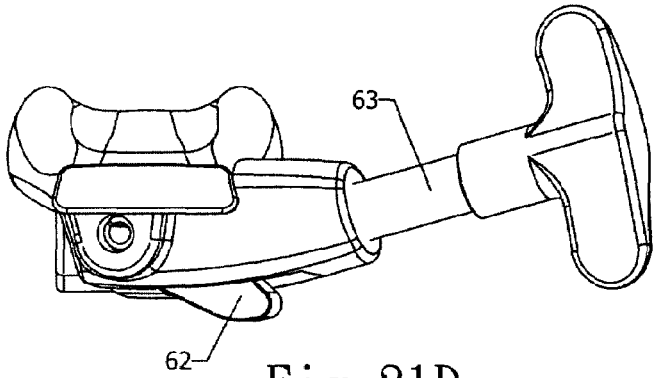
Figure 21E:
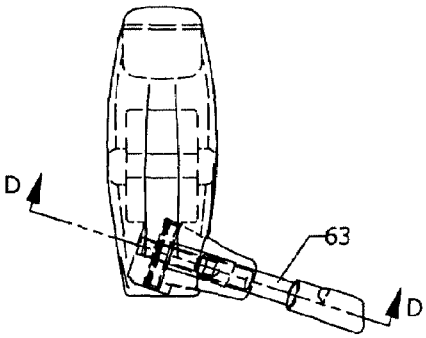
Figure 21F:
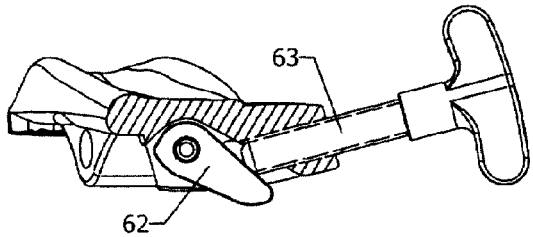

FIG. 20 shows the drum clamping assembly 60. Clamp 61 is attached to tower 20 shows in FIG. 7 by passing mounting rod 612 through clamp mounting hole 611. This creates a jawlike clamping device which attaches to a conventional bass drum counterhoop or other musical accessory attachment suitably disposed. FIG. 21 shows 6 drawings, 21A, 21B, 21C, 21D, 21E and 21F. FIGS. 21A and 21B show the clamp lever in a raised position which to effects the closing of the clamp. FIGS. 21C and 21D show the clamp lever lowered to effect and unclamping which release pressure on the bass drum hoop or other device. FIG. 21E shows the plan view of the clamp to show angularity to enhance ease of access for the operator to reach the clamp lever screw 63. FIG. 21F shows a cross-section drawing of the clamp assembly which illustrates the effect of the clamp lever screw as it is turned by the operator. As the screw 63 is turned clockwise, the lever 62 lifts, putting pressure against the base plate and thereby transmitting clamping pressure to the drum hoop or requisite attachment. The function of the clamp lever 62 is constitutes a preferred embodiment of the invention.

While we have shown and described the preferred embodiments in accordance with the present invention, it should be clear to those skilled in the art that further embodiments may be made without departing from the scope of the present invention.

What is claimed is:

1. A modular drum pedal system comprising:

at least one horizontal base, in the form of a plate, comprising a drum facing end—a rear, and a drummer facing end—a front, and means for mounting on the rear end of the plate on one of the rear side areas of the plate;

at least one vertical single tower assembly extending from a mounting area on the plate-like horizontal base to a tower top end, having a horizontal beam section spaced downward from the top end of the tower, but distal from the base, that extends laterally from the tower above the base toward the other side, wherein the beam has a connection section for receiving a connection rod and attaching an extension beam at the overhanging end;

a secondary vertical support in the tower assembly, further comprising a second horizontal beam section for connecting and extending from the overhanging end of the first horizontal beam section by the stabilizer rod, the assembly extending laterally from the tower, to the other side of the base from the tower;

bearing supports and bearings, facing inwardly, in the top ends of the tower and the secondary vertical support, respectively;

a drive transmission unit comprising a horizontal drive shaft and a pedal, the drive shaft rotatably connected to the vertical bearing supports which make up the vertical single tower assembly, the pedal pivotally connected to the base and driving the drive shaft to, rotate, said horizontal drive shaft being insertable within a bearing contained within said vertical bearing support for rotation of said drive shaft with respect to said vertical tower, and a beater assembly driven by the drive transmission unit and being co-rotated with the drive transmission unit.

2. The assembly as claimed in claim 1, wherein a returning device has one end connected to the at least one vertical tower and the other end of the returning device is connected to the drive transmission unit so as to return the drive unit and the beater assembly to their initial positions.

3. The assembly as claimed in claim 1, wherein an adjusting unit is connected between the drive shaft and a chain or strap which is moved by the adjusting unit so as to adjust the pedal and the beater assembly.

4. The assembly as claimed in claim 1, wherein the connection section of the tower has a horizontally directed ridge and the second horizontal beam of the secondary vertical support includes a groove formed within its connection section with which the ridge is engaged.

5. The assembly as claimed in claim 1, wherein two bearings are respectively connected to the at least one vertical tower and the vertical support, two ends of the drive shaft are cooperated with the two bearings.

6. The assembly as claimed in claim 1, wherein the at least one vertical tower assembly is located at a first side area of the base opposing a second side area.

7. The assembly as claimed in claim 1, wherein the at least one vertical tower assembly is located at a second side area of the base opposing a first side area.

8. The assembly as claimed in claim 1, wherein two vertical towers attached to one vertical support are located at a right side and left side of the base.

9. A drum pedal assembly comprising:

at least one horizontal base, in the form of a plate, comprising a drum facing end—a rear, and a drummer facing end—a front, and means for mounting on the rear end of the plate on one of the rear side areas of the plate;

at least one vertical single tower assembly extending from a mounting area on the plate-like horizontal base to a tower top end, having a horizontal beam section spaced downward from the top end of the tower, but distal from the base, that extends laterally from the tower above the base toward the other side, wherein the beam has a connection section for receiving a connection rod and attaching an extension beam at the overhanging end;

a secondary vertical support in the tower assembly, further comprising a second horizontal beam section for connecting and extending from the overhanging end of the first horizontal beam section by the stabilizer rod, the assembly extending laterally from the tower, to the other side of the base from the tower;

bearing supports and bearings, facing inwardly, in the top ends of the tower and the secondary vertical support, respectively;

a transmission unit having a horizontal drive shaft and a pedal, the drive shaft rotatably connected between the at least one vertical tower and the vertical bearing supports, the pedal pivotally connected to the base and driving the drive shaft to rotate, said horizontal drive shaft being insertable within a bearing contained within said vertical bearing support for rotation of said drive shaft with respect to said vertical tower;

a beater assembly driven by the transmission unit and being co-rotated with the transmission unit, and an adjusting unit connected between the drive shaft and a chain or strap which is moved by the adjusting unit so as to adjust the pedal and the beater assembly.

10. The assembly as claimed in claim 9, wherein the adjusting unit includes a cam member which is connected to the drive shaft and at least one elongate hole is defined through the cam member, a chain support is movably connected to the at least one elongate hole of the cam member, the chain has one end fixed to the chain support and the other end of the chain is connected to the pedal, an adjusting knob is connected to the at least are elongate hole with which the chain support is connected.

11. The assembly as claimed in claim 9, wherein a bolt extends through a chain support and another elongate hole in the cam member the adjusting knob has an outer periphery compressing the bolt.

12. The assembly as claimed in claim 9, wherein a returning device has one end connected to the at least one vertical tower and the other end of the returning device is connected to the transmission unit so as to return the transmission unit and the beater assembly to their initial positions.

13. The assembly as claimed in claim 9, wherein the connection section of the tower has a horizontally directed ridge and the second horizontal beam of the secondary vertical support includes a groove formed within its connection section with which the ridge is engaged.

14. The assembly as claimed in claim 9, wherein two bearings are respectively connected to the at least one vertical tower and the support, two ends of the drive shaft are cooperated with the two bearings.

15. The assembly as claimed in claim 9, wherein the at least one vertical tower assembly is located at a first side area of the base opposing a second side area.

16. The assembly as claimed in claim 9, wherein the at least one vertical tower assembly is located at a second side area of the base opposing a first side area.

17. The assembly as claimed in claim 9, wherein two vertical towers are located at right side and left side of the base.

18. A drum pedal assembly comprising:

at least one horizontal base, in the form of a plate, comprising a drum facing end—a rear, and a drummer facing end—a front, and means for mounting on the rear end of the plate on one of the rear side areas of the plate;

at least one vertical single tower assembly extending from a mounting area on the plate-like horizontal base to a tower top end, having a horizontal beam section spaced downward from the top end of the tower, but distal from the base, that extends laterally from the tower above the base toward the other side, wherein the beam has a connection section for receiving a connection rod and attaching an extension beam at the overhanging end;

a secondary vertical support in the tower assembly, further comprising a second horizontal beam section for connecting and extending from the overhanging end of the first horizontal beam section by the stabilizer rod, the assembly extending laterally from the tower, to the other side of the base from the tower;

bearing supports and bearings, facing inwardly, in the top ends of the tower and the secondary vertical support, respectively;

a transmission unit having a horizontal drive shaft and a pedal, the drive shaft rotatably connected between tie at least one vertical tower and the vertical bearing supports, the pedal pivotally connected to the base and driving the drive shaft to rotate, said horizontal drive shaft being insertable within a bearing contained within said vertical bearing support for rotation of said drive shaft with respect to said vertical tower;

a beater assembly driven by the transmission unit and being co-rotated with the transmission unit, and a pedal adjusting unit connected to an overlapped portion of a front plate and a rear plate of the base so as to adjust a length of the base.

19. The assembly as claimed in claim 18, wherein the pedal adjusting unit includes a heel plate which is fixed to the rear plate of the base and the pedal is pivotally connected to the heel plate.

20. The assembly as claimed in claim 18, wherein a guide groove is defined in an end of the rear plate and a positioning bolt extends trough the front plate and movably engaged with the guide groove, a positioning plate is connected to the positioning bolt so as press the overlap portion of the front an drear plates, a knob is connected to a top of the positioning plate here the wing out is connected to the end of poisoning screw and sits on top of the positioning plate.

21. The assembly as claimed in claim 18, wherein a returning device has one end connected to the at least one vertical tower and the other end of the returning device is connected to the transmission unit so as to return the transmission unit and the beater assembly to their initial positions.

22. The assembly as claimed in claim 18, wherein an adjusting unit is connected between the drive shaft and a chain which is moved by the adjusting unit so to adjust the pedal and the beater assembly.

23. The assembly as claimed in claim 18, wherein the connection section of the tower has a horizontally directed ridge and the second horizontal beam of the secondary vertical support includes a groove formed within its connection section with which the ridge is engaged.

24. The assembly as claimed in claim 18, wherein two bearings are respectively connected to the at least one vertical tower and the support, two ends of the drive shaft are cooperated with the two bearings.

25. The assembly as claimed in claim 18, wherein the at least one vertical tower assembly is located at a first side area of the base opposing a second side area.

26. The assembly as claimed in claim 18, wherein the at least one vertical tower assembly is located at a second side area of the base opposing a first side area.

27. The assembly as claimed in claim 18, wherein two vertical towers are located at tight side and left side of the base.

28. A drum pedal assembly comprising:

at least one horizontal base, in the form of a plate, comprising a drum facing end—a rear, and a drummer facing end—a front, and means for mounting on the rear end of the plate on one of the rear side areas of the plate;

at least one vertical single tower assembly extending from a mounting area on the plate-like horizontal base to a tower top end, having a horizontal beam section spaced downward from the top end of the tower, but distal from the base, that extends laterally from the tower above the base toward the other side, wherein the beam has a connection section for receiving a connection rod and attaching an extension beam at the overhanging end;

a secondary vertical support in the tower assembly, further comprising a second horizontal beam section for connecting and extending from the overhanging end of the first horizontal beam section by the stabilizer rod, the assembly extending laterally from the tower, to the other side of the base from the tower;

bearing supports and bearings, facing inwardly, in the top ends of the tower and the secondary vertical support, respectively;

a transmission unit having a horizontal drive shaft and a pedal, the drive shaft rotatably connected between the at least one vertical tower and the vertical bearing supports, the pedal pivotally connected to the base and driving the drive shaft to rotate, said horizontal drive shaft being insertable within a bearing contained within said vertical bearing support for rotation of said drive shaft with respect to said vertical tower, and a beater assembly having a correction rod which is connected to the drive shaft through a clamp member, said connection rod being co-rotated with the drive shaft, a polygonal engaging hole defined through the connection rod, a beater having an extension rod which is engaged with the polygonal engaging hole and the beater having a plurality of beat faces, said clamp member having jaws forming a slot for receiving said connection rod and a bolt extending through said jaws for clamping said clamp member to said connection rod.

29. The assembly as claimed in claim 28, wherein the beater includes three beat faces defined on an outer periphery thereof and the extension rod has a hexagonal cross section and the polygonal engaging hole is a six sided polygonal hole.

30. The assembly as claimed in claim 28, wherein a returning device has one end connected to the at least one vertical tower and the other end of the returning device is connected to the transmission unit so as to return the transmission unit and the beater assembly to their initial positions.

31. The assembly as claimed in claim 28, wherein an adjusting unit is connected between the drive shaft and a chain which is moved by the adjusting unit so as to adjust the pedal and the beater assembly.

32. The assembly as claimed in claim 28, wherein the connection section of the tower has a horizontally directed ridge and the second horizontal beam of the secondary vertical support includes a groove formed within its connection section with which the ridge is engaged. Replace claim 34 with the following:

33. The assembly as claimed in claim 28, wherein the at least one vertical tower assembly is located at a first side area of the base opposing a second side area.

34. The assembly as claimed in claim 28, wherein the at least one vertical tower assembly is located at a second side area of the base opposing a first side area.

35. The assembly as claimed in claim 28, wherein two vertical towers are located at right side and left side of the base.

36. A drum pedal assembly comprising:

at least one horizontal base, in the form of a plate, comprising a drum facing end—a rear, and a drummer facing end—a front, and means for mounting on the rear end of the plate on one of the rear side areas of the plate;

at least one vertical single tower assembly extending from a mounting area on the plate-like horizontal base to a tower top end, having a horizontal beam section spaced downward from the top end of the tower, but distal from the base, that extends laterally from the tower above the base toward the other side, wherein the beam has a connection section for receiving a connection rod and attaching an extension beam at the overhanging end;

a secondary vertical support in the tower assembly, further comprising a second horizontal beam section for connecting and extending from the overhanging end of the first horizontal beam section by the stabilizer rod, the assembly extending laterally from the tower, to the other side of the base from the tower;

bearing supports and bearings, facing inwardly, in the top ends of the tower and the secondary vertical support, respectively;

a transmission unit having a horizontal drive shaft and a pedal, the drive shaft rotatably connected between the at least one vertical tower and the vertical bearing supports, the pedal pivotally connected to the base and driving the drive shaft to rotate, said horizontal drive shaft being insertable within a bearing contained within said vertical bearing support for rotation of said drive shaft with respect to vertical tower;

a beater assembly driven by the transmission unit and being co-rotated with the transmission unit, and a returning device connected to the at least one vertical tower and having a first frame connected to the drive shaft and a second frame which is rotatably connected to the first frame by a bearing, a returning unit connected to the at least one vertical tower and a spring having one end connected to the returning unit and the other end of the spring connected to the second frame.

37. The assembly as claimed in claim 36, wherein the connection section of the tower has a horizontally directed ridge and the second horizontal beam of the secondary vertical support includes a groove formed within its connection section with which the ridge is engaged.

38. The assembly as claimed in claim 36, wherein two bearings are respectively connected to the at least one vertical tower and the support, two ends of the drive shaft are cooperated with the two bearings.

39. The assembly as claimed in claim 36, wherein the at least one vertical tower assembly is located at a first side area of the base opposing a second side area.

40. The assembly as claimed in claim 36, wherein the at least one vertical tower assembly is located at a second side area of the base opposing a first side area.

41. The assembly as claimed in claim 36, wherein two vertical towers are located at right side and left side of the base.

* * * * *